United States Patent [19]

Jespersen

[11] Patent Number: 4,944,466

[45] **Date of Patent: * Jul. 31, 1990**

[54] FLEXIBLE SHEET MATERIAL DISPENSER WITH AUTOMATIC ROLL TRANSFERRING MECHANISM

[75] Inventor: Paul W. Jespersen, Houston, Tex.

[73] Assignee: Georgia-Pacific Corporation, Atlanta, Ga.

[ * ] Notice: The portion of the term of this patent subsequent to Aug. 15, 2006 has been disclaimed.

[21] Appl. No.: 352,110

[22] Filed: May 17, 1989

Related U.S. Application Data

[63] Continuation-in-part of Ser. No. 218,994, Jul. 14, 1988, Pat. No. 4,856,724.

[51] Int. Cl.[5] ..... B65H 19/00

[52] U.S. Cl. ..... 242/55.3; 242/55.2; 312/39

[58] Field of Search ..... 242/55.2, 55.3, 55.53; 312/38, 39

[56] References Cited

U.S. PATENT DOCUMENTS

| | | | |
|---|---|---|---|
| 2,299,301 | 10/1942 | Britt | 242/55.3 |
| 3,438,589 | 4/1969 | Jespersen | 242/55.2 |
| 3,690,580 | 9/1972 | Jespersen | 242/55.3 |
| 3,770,222 | 11/1973 | Jespersen | 242/55.3 |
| 3,771,739 | 11/1973 | Nelson | 242/55.3 |
| 4,108,389 | 8/1978 | Womack | 242/55.3 |
| 4,137,805 | 2/1979 | DeLuca et al. | 242/55.3 X |
| 4,142,431 | 3/1979 | Jespersen | 242/55.2 X |
| 4,203,562 | 5/1980 | DeLuca et al. . | |
| 4,206,858 | 6/1980 | DeLuca et al. | 225/96 |
| 4,236,679 | 12/1980 | Jespersen | 242/55.53 |
| 4,307,638 | 12/1981 | DeLuca et al. | 242/55.3 X |
| 4,307,639 | 12/1981 | DeLuca | 242/55.3 X |
| 4,340,195 | 7/1982 | DeLuca | 242/55.3 |
| 4,441,392 | 4/1984 | DeLuca . | |
| 4,487,375 | 12/1984 | Rasmussen et al. . | |
| 4,522,346 | 6/1985 | Jespersen | 242/55.3 |
| 4,552,315 | 11/1985 | Granger . | |

*Primary Examiner*—Stuart S. Levy
*Assistant Examiner*—Steven M. duBois
*Attorney, Agent, or Firm*—Banner, Birch, McKie & Beckett

[57] ABSTRACT

A dispenser for rolls of flexible sheet material wound on cores is disclosed. The dispenser holds multiple rolls and includes guide tracks for guiding the rolls through the dispenser. A holding lever pivotably connected to each side of the dispenser selectively holds the rolls in position in the dispenser and has its pivoting motion controlled by a sensing plate which contacts a lower dispensing roll to sense when the sheet material is substantially depleted. The lower dispensing roll is always held out of contact with rollers of a dispensing mechanism. A shield is located between the roll surface of the lower dispensing roll and the rollers of the dispensing mechanism.

31 Claims, 17 Drawing Sheets

FLEXIBLE SHEET MATERIAL DISPENSER WITH AUTOMATIC ROLL TRANSFERRING MECHANISM

RELATED APPLICATION

This application is a continuation-in-part application of Application Ser. No. 218,994, filed on July 14, 1988, now U.S. Pat. No. 4,856,724.

TECHNICAL FIELD

This invention relates to dispensers for flexible sheet material such as paper toweling and, more particularly, to an automatic roll transfer device which minimizes excessive unwinding of sheet material from the roll and jamming of the dispensing mechanism of the dispenser.

BACKGROUND OF THE INVENTION

Numerous types of dispensers for flexible sheet material wound on cores, such as rolls of paper towels, are known in the prior art. The core on which the flexible sheet material is wound typically has supporting spindles extending beyond the ends of the rolls. The spindles are used to support the roll in, and guide it through, the dispenser. Prior art dispensers frequently use a dispensing or feed mechanism, generally comprising a plurality of rollers, to feed the sheet material out of the dispenser. Such dispensing mechanisms have included a cutter which cuts a preselected length of the sheet material being dispensed. In typical prior art dispensers, the roll surface of the dispensing roll has rested on one of the rollers of the dispensing mechanism. Thus, whenever sheet material is advanced through the dispensing mechanism, the dispensing roll is rotated by virtue of its contact with a roller of the dispensing mechanism.

One type of prior art dispenser is a multiple roll dispenser wherein a first roll, from which the sheet material is being dispensed, is automatically moved to a temporary storage position when nearly depleted and a second reserve roll is moved into a dispensing position. U.S. Pat. No. 4,236,679 to Jespersen, discloses both a single roll and a multiple roll dispenser. In the multiple roll dispenser, the remaining sheet material on a first dispensing roll, after its core has dropped to a core storage position, is used to rotate a second reserve roll to thread the sheet material from the reserve roll through the dispensing mechanism. The automatic initiation of dispensing from the second reserve roll is important to the convenience of use of multiple roll dispensers.

The roll surface of the dispensing roll in the multiple roll dispenser disclosed in the '679 patent rests on the feed roller of the dispensing mechanism. Likewise, after the dispensing roll has dropped to a storage position, the reserve roll is lowered and placed in direct contact with the feed roller of the dispensing mechanism through contact with the remaining length of sheet material on the dispensing roll in order to thread the leading edge of the sheet material from the reserve roll through the dispensing mechanism. U.S. Pat. No. 4,307,639 to DeLuca et al. similarly discloses a multiple roll dispenser in which the dispensing roll, as well as the reserve roll after it has dropped into the dispensing position, rest on one of the rollers of the dispensing mechanism. Specifically, the roll rests both on a feed roller and, for a period of time, on a pressure roller of the dispensing mechanism. U.S. Pat. No. 4,307,638 to DeLuca et al. also discloses a multiple roll dispenser wherein the roll surface of the roll from which sheet material is being dispensed rests on one of the rollers of the dispensing or feed mechanisms. In the dispenser disclosed in the '638 patent, the roll rests on a pinch roller of the dispensing mechanism, rather than the primary feed roller.

The technique of placing the roll surface of the roll from which sheet material is being dispensed in direct contact with a roller of the dispensing mechanism is a convenient way to initiate dispensing from a reserve roll which has dropped to a dispensing position in a multiple roll dispenser. However, the direct contact between the dispensing roll and a roller of the dispensing mechanism can cause jamming problems. First, there is no fixed location in such prior art mechanisms for the center of the core of the dispensing roll. Since the roll surface must remain in contact with the roller of the dispensing mechanism, the rotation axis must continuously change as the diameter of the roll diminishes. Thus, no mechanism is provided to ensure that the axis of the core remains parallel to the roller on which the dispensing roll rests. If soft-wound rolls of sheet material are used, one end of the core can rise above or fall below the other end of the core causing the sheet material to travel to one side as it is withdrawn. Such uneven dispensing of the sheet material eventually jams the feed mechanism. Second, if the dispensing roll is rapidly rotated and then brought to a sudden stop, over spinning will occur. While braking mechanisms have been incorporated into prior art dispensers to reduce overspin, it generally can not be completely stopped. If the dispensing roll rests directly on one of the rollers of the feed mechanism, it will jump forward of the roll at each sudden stop, creating an unraveled loop of loose sheet material in the dispensing mechanism adjacent the roller. The size of this loop increases with each use of the dispenser, since the roll of sheet material rotates together with the rollers of the dispensing mechanism. Again the dispensing mechanism eventually jams.

A device and technique was thus needed to reliably initiate the feeding of sheet material through a dispensing mechanism from a roll that is lowered from a reserve to a dispensing position while reducing the likelihood of jamming of the dispensing mechanism. The present invention was developed to accomplish this objective.

SUMMARY OF THE INVENTION

The present invention is directed to a dispenser for rolls of flexible sheet material wound on cores, wherein the cores have ends extending beyond the sides of the rolls. The dispenser includes a housing having opposite sidewalls with each sidewall having a guide track comprising a substantially vertical channel formed between lateral walls for receiving and guiding the core ends. A substantially vertically disposed holding lever is pivotably attached to each sidewall and includes an upper projection adjacent an upper end of the guide track for retaining a reserve roll of flexible sheet material at an upper reserve position along the guide track and a lower projection adjacent a lower end of the guide track for retaining a dispensing roll of flexible sheet material at a lower position along the guide track. A transfer roller is supported in the housing adjacent the lower end of the guide track. A dispensing mechanism, including one or more rollers, is supported in the housing adjacent the dispensing roll and laterally of the transfer roller for dispensing sheet material from the dispensing roll and out of the dispenser.

In one embodiment, the transfer roller and the lower projects of the holding levers are located in the housing a predetermined distance from one another so that a dispensing roll contacts and is supported by the transfer roller at a sheet transfer position with its core ends above and out of contact with the lower projections until a predetermined amount of sheet material is dispensed from the dispensing roll. The dispensing roll is supported by the lower projections at the dispensing position after the predetermined amount of sheet material is dispensed. This embodiment of dispenser can be designed so that the transfer roller supports the dispensing roll while only a small amount of sheet material is dispensed, or while a large amount of sheet material is dispensed, for example, a major portion or substantially all the sheet material. If soft-wound rolls of sheet material is to be dispensed, it is preferred that the transfer roller support the dispensing roll while only a small amount of sheet material is dispensed. In this manner, the lower projections will support the dispensing dispensing roll at a constant axis during a major portion of the dispensing, so that uneven dispensing of the sheet material, due to the soft nature of the roll, is prevented. However, if hard wound rolls are to be dispensed, the dispensing roll could be supported on the transfer roller for a major portion of the dispensing action without one end of the roll rising up and out of alignment with the other end of the roll.

In another embodiment the dispensing roll is held at a fixed constant axis by the lower projections from the beginning of dispensing of the sheet material by the lower projections, and the transfer roller is biased into contact with the sheet material on the dispensing roll until the predetermined amount of sheet material has been dispensed. The lower end of the guide tracks in both of these embodiments are positioned with respect to the dispensing mechanism to locate the dispensing roll out of contact with rollers of the dispensing mechanism.

In a preferred embodiment, the dispenser includes a sensing mechanism for sensing the reducing diameter of the dispensing roll as sheet material is dispensed from the dispensing roll; and a release mechanism for releasing the holding levers to allow the levers to pivot from a holding position in which the upper and lower projections are positioned to hold rolls of sheet material in the reserve and dispensing positions to a release position in which the reserve and dispensing rolls are free to move downwardly along the guide tracks. A coupling mechanism couples the sensing mechanism to the release mechanism to activate the release mechanism when the diameter of the dispensing roll has been reduced a predetermined amount so that the dispensing roll is substantially depleted but has a remaining length of sheet material. The housing includes a storage mechanism for holding a substantially depleted dispensing roll after the holding levers are allowed to pivot to the release position. The storage mechanism is located in the housing with respect to the transfer roller so that the remaining length of sheet material remains in contact with the transfer roller to thereby contact and simultaneously feed sheet material from a full reserve roll which has been lowered into contact with the transfer roller.

The present invention is also directed to a method for dispensing sheet material wherein the outer surface of the dispensing roll is kept out of contact with rollers of the dispensing mechanism, while at the same time assuring initiation of dispensing from a reserve roll.

The present invention alleviates the above-discussed problems of prior art multiple roll dispensers, while still attaining reliable feeding from the multiple rolls in the dispenser. Feeding of the sheet material from a reserve roll is initiated automatically by placing its roll surface in contact with the sheet material in the storage position, while the jamming problems caused by having a roll surface in contact with a roller of the dispensing mechanism are eliminated since the roll surface never contacts a roller of the dispensing mechanism. The sheet material does not feed unevenly since in several embodiments the dispensing roll is held at a constant axis during all or a major portion of the dispensing process, also reducing the likelihood of jamming in the dispensing mechanism, particularly when sheet material from soft-wound rolls is to be dispensed.

Further objects, features and other aspects of this invention will be understood from the following detailed description of the preferred embodiments of this invention with reference to the attached drawing figures.

DESCRIPTION OF THE PREFERRED EMBODIMENTS

Figure 1:
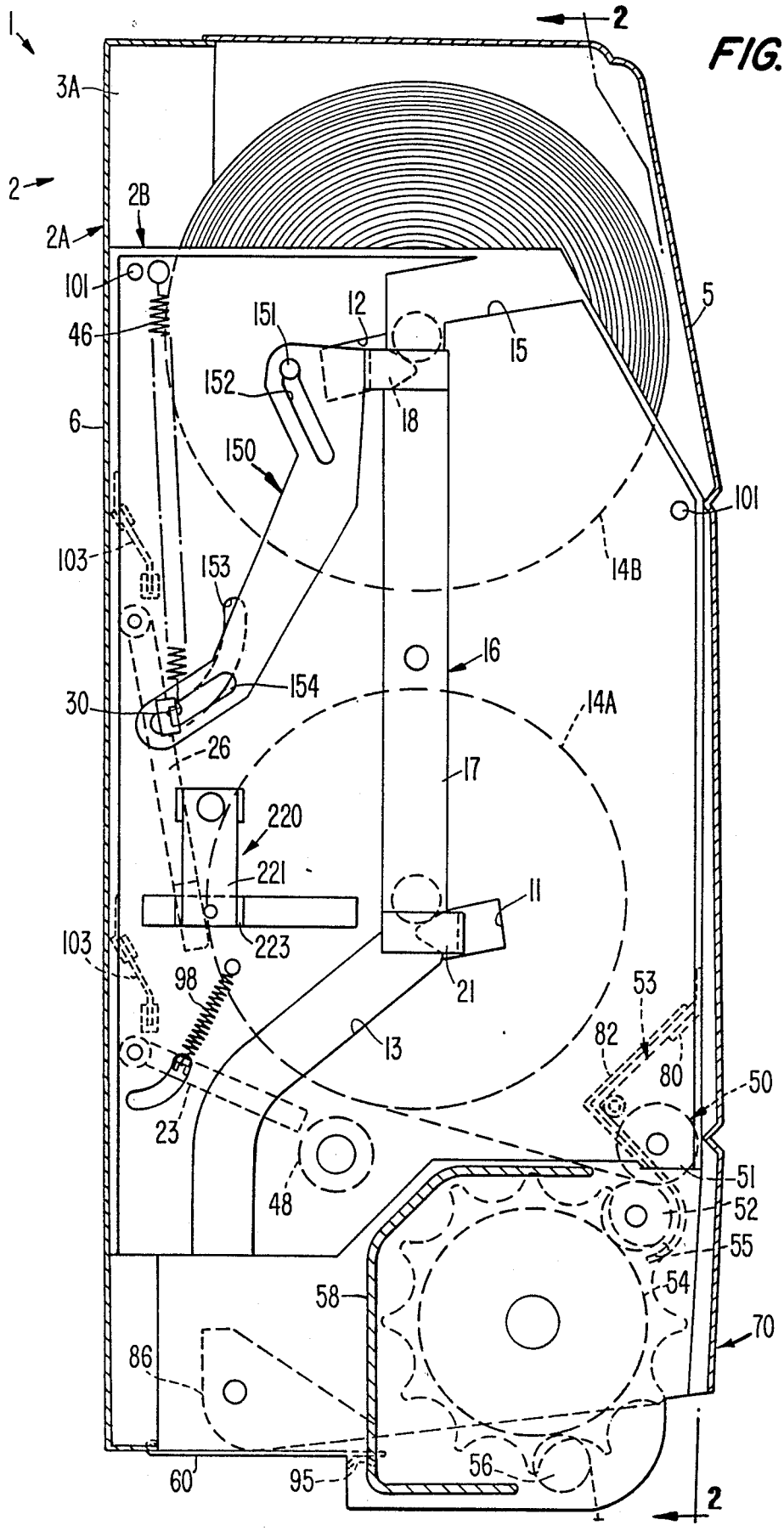
FIG. 1 is a side view, partially broken away and partially in section, of a roll dispenser according to the present invention showing a dispensing roll and a reserve roll in their normal positions during operation of the dispenser.

Referring to the drawings wherein like numerals indicate like elements, a dispenser, designated generally as 1, is illustrated. Dispenser 1 includes a housing 2 for holding multiple rolls of sheet material, such as paper towel and the like, wound over cores. Housing 2 includes an external housing 2a and an internal housing 2b removably attached inside external housing 2a. The rolls are supported and guided through housing 2 by guide tracks 7 and 8, and a pivotable holding lever 16. The pivoting of holding lever 16 in turn is controlled by a sensing/retainer plate mechanism. Sheet material is dispensed from dispenser 1 through a dispensing or feed mechanism 70. FIG. 1 illustrates dispenser 1 in a operational situation where a first dispensing roll 14a is held at a dispensing position and a second reserve roll 14b is held at a reserve position above and out of contact with dispensing roll 14a.

Figure 10:
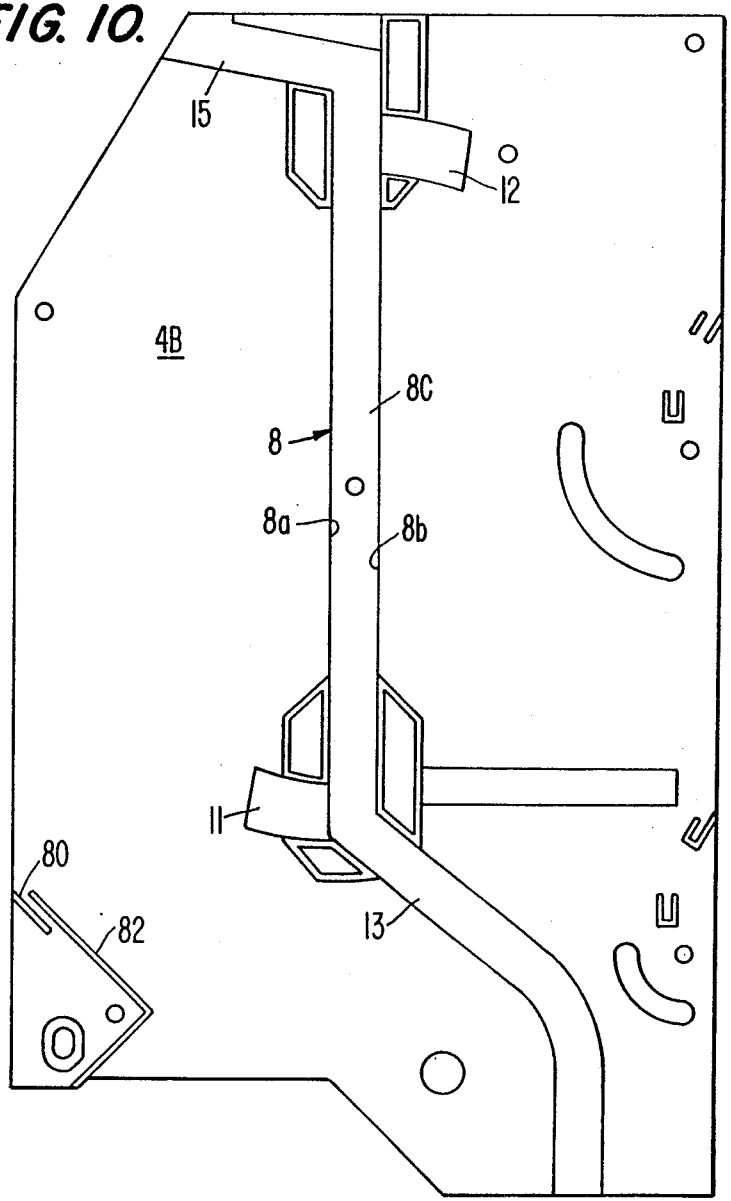
FIG. 10 is a view of the other side of the internal housing of the roll dispenser.
Figure 9:
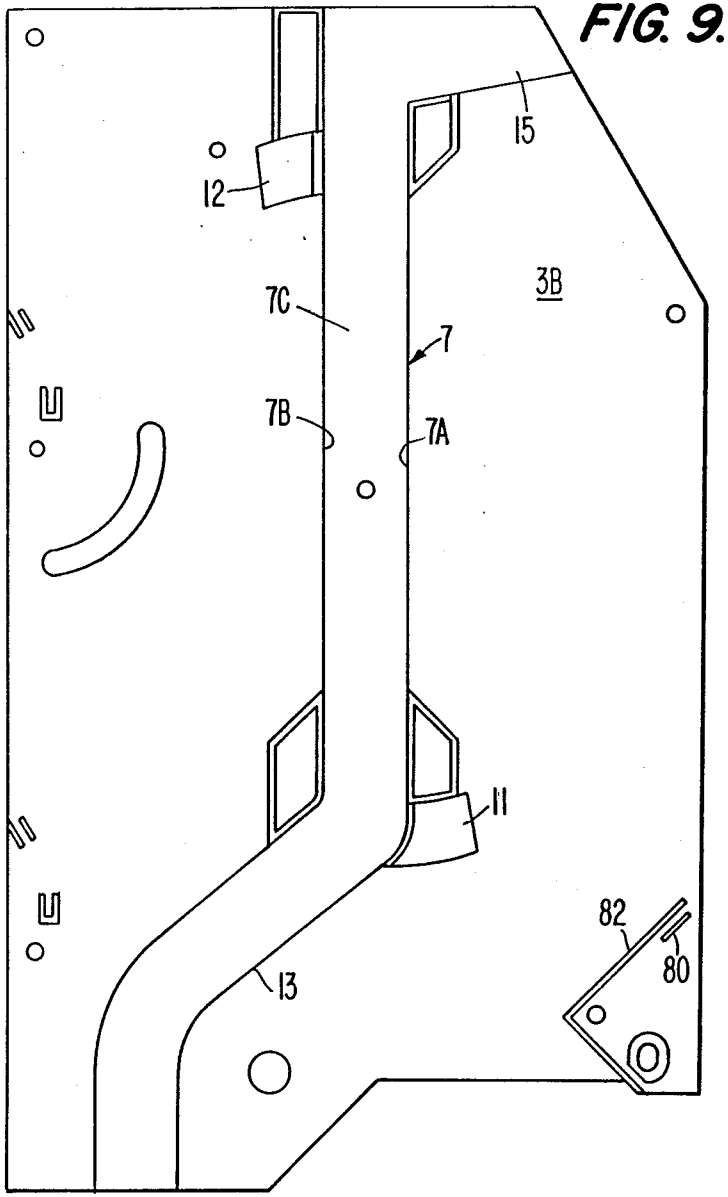
FIG. 9 is a view of one side of the internal housing of the roll dispenser.

External Housing 2a includes a front cover 5, sidewalls 3a and 4a and a back wall 6. Internal housing 2b includes sidewalls 3b and 4b held together in a spaced, parallel relationship by a plurality of rods 101, plates 103 and portions of dispensing mechanism 70. Internal housing 2b is attached to backwall 6 of external housing 2a in a conventional manner, such as by clips 105 receiving one or more rods 101. FIG. 9 shows the inner surface of right sidewall 3b and FIG. 10 shows the inner surface of left sidewall 4b, with the orientation of the system being determined by facing the front of housing 2. Sidewalls 3b and 4b are preferably each formed of a single molded piece of plastic. Guide track 7 is formed in right sidewall 3b and guide track 8 is formed in left sidewall 4b. The guide tracks are nearly identical except that left track 8b is narrower than right track 7b to assure proper orientation of the rolls of sheet material which are inserted into dispenser 1. Otherwise, dispenser 1 is symmetrical so that similar components are located on both the left and right sides of dispenser 1. The components of dispenser 1 will therefore only be discussed with respect to one side, with the understanding that a like component is located on the other side of dispenser 1, unless otherwise indicated.

Guide track 7 includes opposed sidewalls 7a and 7b forming a central channel 7c. Guide track 7 is orientated substantially vertically with the exception of a lower lateral portion 13 which extends downward towards back wall 6, and an upper lateral portion 15 of wall 7c which extends upward toward cover 5. A lower opening 11 extends through sidewall 3b and lateral sidewall 7a at the bottom of the vertical portion of guide track 7 where it meets lower lateral portion 13, and an upper opening 12 extends through sidewall 3b and opposite lateral sidewall 7b near an upper portion of guide track 7.

A holding lever 16 includes a vertical portion 17, an upper projection 18 and a lower projection 21. Vertical portion 17 is pivotably attached to sidewall 3b by a fastener such as a screw. When vertical portion 17 is disposed horizontally, upper projection 18 extends through opening 12 into channel 7c and lower projection 21 extends through opening 11 into channel 7c.

Figure 4:
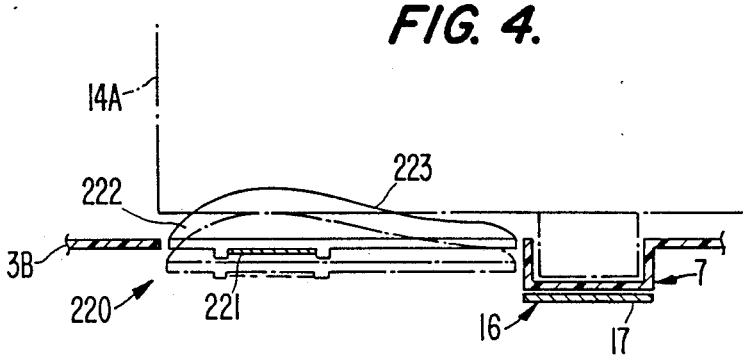
FIG. 4 is a cross-sectional view taken generally along line 4—4 of FIG. 3.

A brake mechanism 220 is attached to sidewall 3b and includes a flat spring 221 and a bearing plate 222. Spring 221 has an upper end attached to the exterior surface of sidewall 3b. Bearing plate 222 is attached to the lower end of spring 221 and extends inwardly through a slot in sidewall 3b. As seen in FIG. 4, plate 222 includes a bearing surface 223 which spring 221 presses against the side of a dispensing roll of sheet material 14a. Bearing surface 223 is shaped, and spring 221 is located along the length of plate 222, such that brake mechanism 220 applies maximum braking force when roll 14a is nearly full and less force as its diameter diminishes. Thus, spring 221 is located in an area adjacent the outer diameter of a full roll 14a, and the widest portion of plate 222 is likewise located in this area. Maximum pressure does not have to be applied by brake mechanism 220 precisely at the outermost diameter of roll 14a since a sensing plate and the weight of roll 14a on a roller also provide braking action at the maximum diameter of the roll.

A sensing plate 26 extends along back wall 6 and is pivotably attached to each of sidewalls 3b, 4b along an axis adjacent back wall 6. A spring 46 is connected to one sidewall and to a flange on a pin 30 projecting from a side of sensing plate 26 to bias it upward against the outer surface of the sheet material on dispensing roll 14*a*. A similar pin 30 projects from the other side of sensing plate 26, but need not be connected to a spring. A retaining plate 150 is movably mounted to sidewall 3*b* by a pin 151 extending from the wall and through a slot 152 in retaining plate 150. Retaining plate 150 is movable both horizontally and vertically along the length of slot 152. Pin 30 projects from sensing plate 26 though an arcuate slot 153 in sidewall 3*b* and thereafter through a lower slot 154 slot in retaining plate 150. Pins 30 thereby couple retaining plate 150 to sensing plate 26.

A transfer roller 48 is rotatably mounted between the opposing sidewalls 3*b* and 4*b* below dispensing roll 14*a*. Dispensing mechanism 70, located near cover 5, includes an input roller 50, a pinch roller 52, a feed roller 54 and an exit roller 56. Input roller 50 is comprised of a plurality of separate rollers 50*a* and 50*b* and disposed across the width of dispenser 1. Input rollers 50*a* and 50*b* are pressed into contact with pinch roller 52 by a flat spring 160 engaging a rod on which the input rollers are supported, and are driven by pinch roller 52.

A transfer plate 53 also extends across the width of dispenser 1 and is secured between brackets 80, 82 extending from the sidewalls 3*b*, 4*b*. Transfer plate 53 includes a loading end 51 and a curved lower end 55. Loading end 51 guides the forward end of the sheet material between input roller 50 and pinch roller 52, and a curved lower end 55 guides the sheet material into the region between pinch roller 52 and feed roller 54. Exit roller 56 is located below feed roller 54 with a stripper bar placed adjacent to both the feed and exit rollers. A cutting mechanism, such as disclosed in U.S. Pat. No. 4,307,638 to DeLuca and Jespersen, which is hereby incorporated by reference, can also be incorporated in feed roller 54. Feed roller 54 is surrounded by shield 58 which extends from an area adjacent exit roller 56, below feed roller 54, upwardly around the back of feed roller 54 and horizontally over the top of feed roller 54 to a location adjacent the intersection of input roller 50 and pinch roller 52. A drop out door 60 extends from shield 58 towards back wall 6 and between sidewalls 3*a* and 4*a*.

Figure 5:
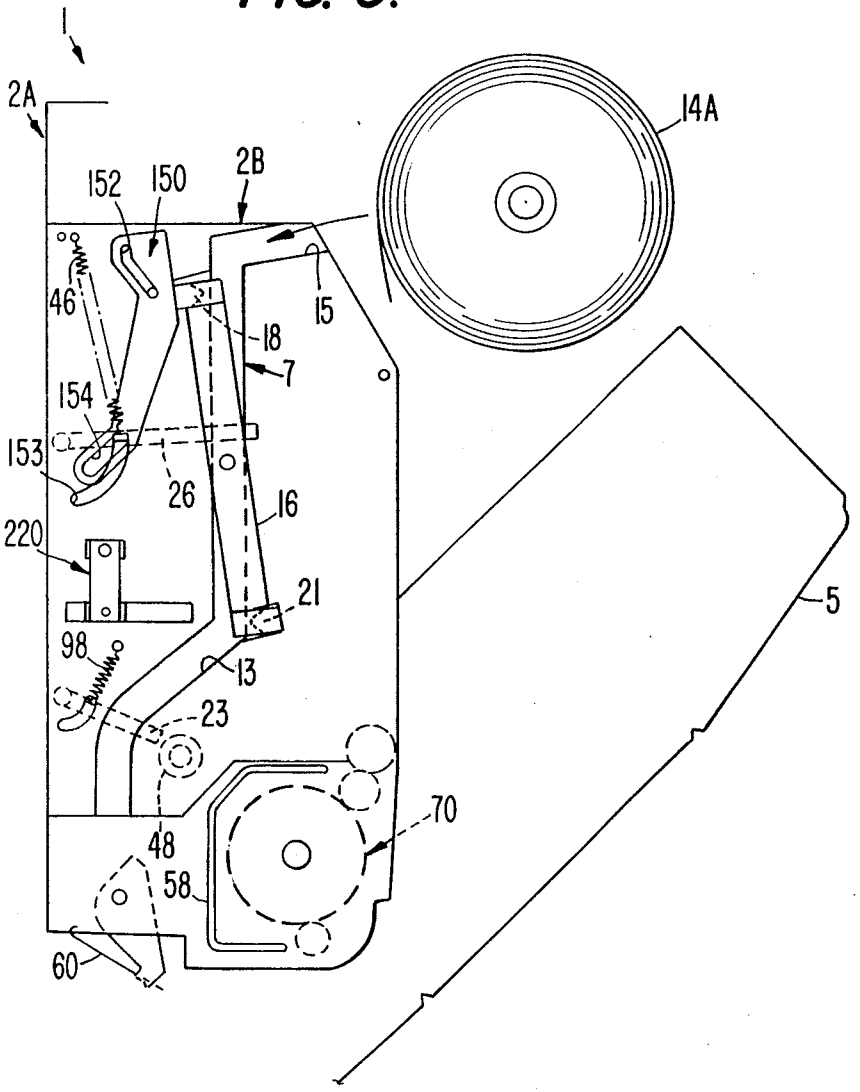
FIG. 5 is a diagrammatic side view illustrating a roll of sheet material being fed into an empty roll dispenser with the cover of the dispenser in the open position.
Figure 8:
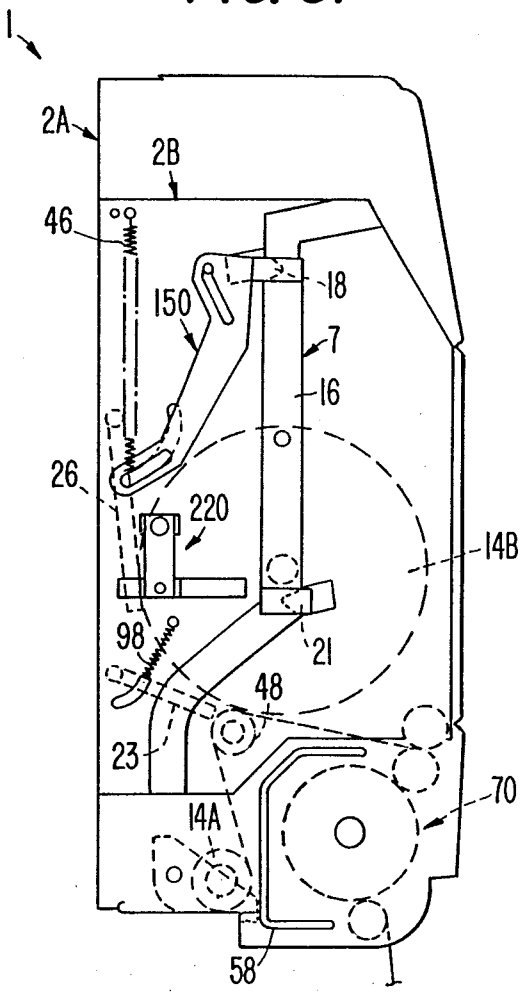
FIG. 8 is a diagrammatic side view showing the roll dispenser with the reserve roll lowered to rest on a transfer roller and being fed through the dispenser together with the remaining material from the dispensing roll held in a storage mechanism.
Figure 11:
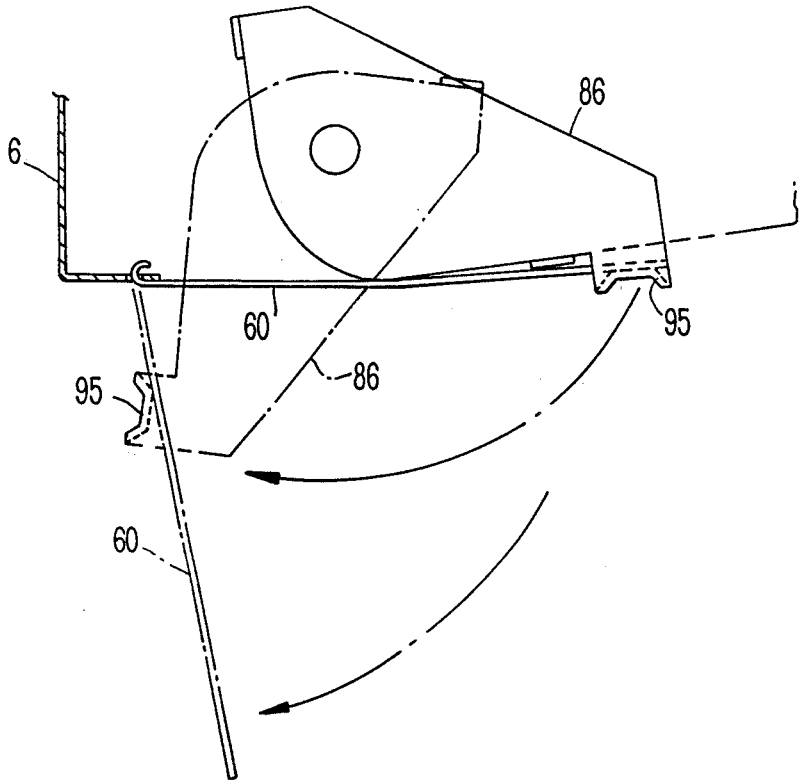
FIG. 11 is an enlarged view of a lower section of the roll dispenser external housing according to the present invention with an empty core access door shown in an open position in phantom line.
Figure 12:
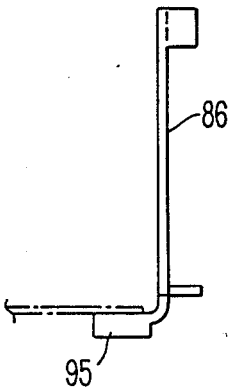
FIG. 12 is a front view of a support plate for the core access door.
Figure 13:
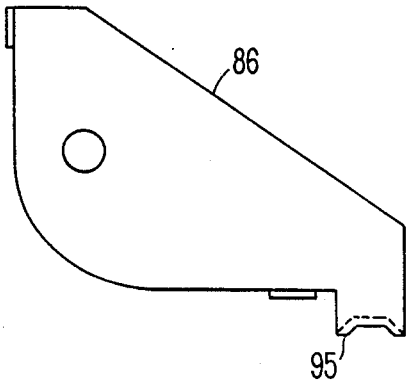
FIG. 13 is a side view of the support plate for the core access door.
Figure 14:
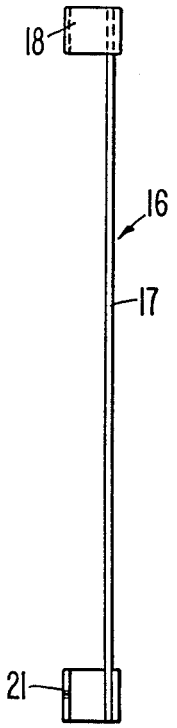
FIG. 14 is a front view of a holding lever.
Figure 15:
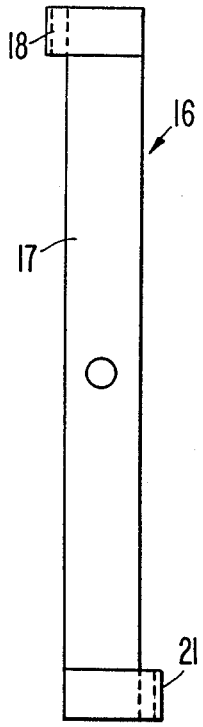
FIG. 15 is a side view of the holding lever.
Figure 16:
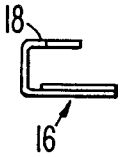
FIG. 16 is a top view of the holding lever illustrating the top projection.

FIGS. 1 and 5–8 show the chronology of loading and dispensing of rolls flexible sheet material from a pair of rolls 14*a* and 14*b*. As shown in FIGS. 5, 8 and 11 dispenser 1 is emptied by pivoting cover 5 which simultaneously lowers drop out door 60 by pivoting door support plates 86 attached to the sides of cover 5 and thereby lowering the support tabs 95 extending from plates 86. Details of door support plates 86 are shown in FIGS. 12 and 13. In this manner cores stored above door 60 are removed. With dispenser 1 empty as shown in FIG. 5, sensing plate 26 is free to move to its uppermost position due to the biasing provided by spring 46. Retaining plate 150 is pushed to its uppermost and rearwardmost position by pins 30 which move upwardly through arcuate slots 153 to contact and push against an upper end of slot 154 in retaining plate 150, thereby forcing plate 150 upward and rearward under the guidance of slot 152 about pin 151.

Figure 6:
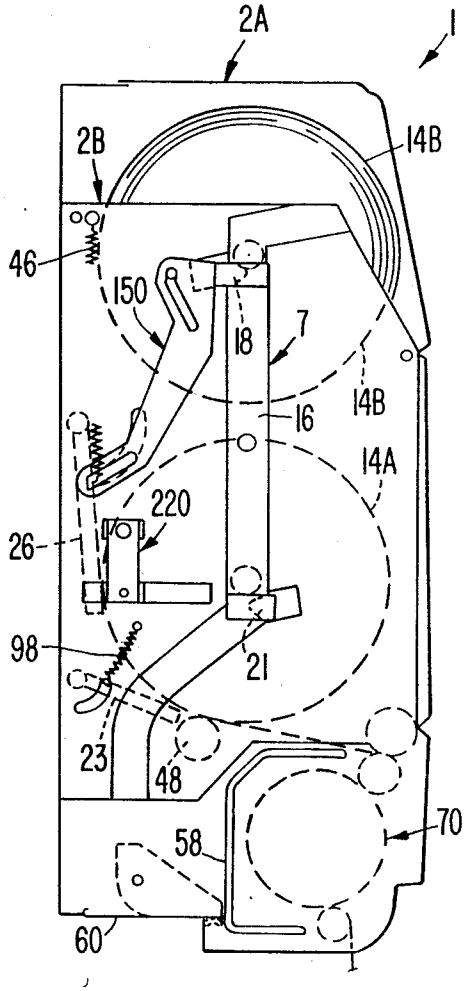
FIG. 6 is a diagrammatic side view showing the roll dispenser with both a full reserve and a full dispensing roll inserted in the dispenser.
Figure 17:
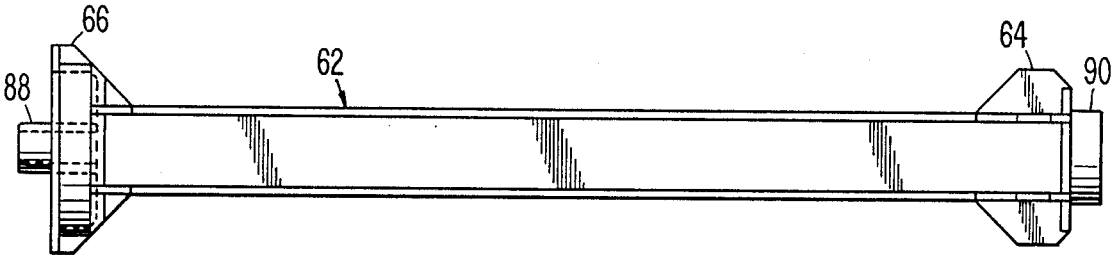
FIG. 17 shows a core support used in the dispensing mechanism according to the present invention.
Figure 18:
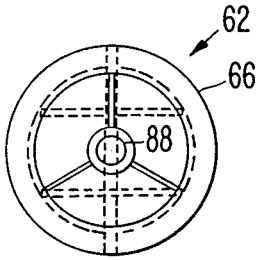
FIG. 18 shows an end view of one side of the core shown in FIG. 17.
Figure 19:
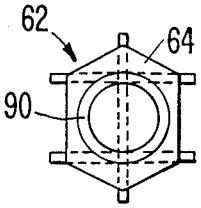
FIG. 19 shows an end view of the opposite side of the core shown in FIG. 17.

FIGS. 17–19 show a core 62 which supports rolls 14. Core 62 has a substantially circular end 66 on one side and a hexagonal end 64 on the other side. Both ends have substantially circular projections 88 and 90 of different diameters which fit in guide tracks 7 and 8. The different diameters of the circular projections assures that core 62 is inserted into the mechanism in its proper orientation. Dispensing roll 14*a* is loaded into dispenser 1 by placing circular projections 88 and 90 of opposite core ends in upper portion 15 of the guide tracks. The weight of dispensing roll 14*a* forces holding lever 16 to pivot out of channels 7*c* and 8*c* by contacting projections 18. Circular projections 88 and 90 slide downwardly through channels 7*c* and 8*c*. Roll 14*a* thus continues to move downwardly under the guidance of the guide tracks until the outer surface of dispensing roll 14*a* contacts transfer roller 48, as shown in FIG. 6. As seen therein, lower projections 21 of holding levers 16 are spaced a predetermined vertical distance from transfer roller 48 so that a full dispensing roll 14*a* rests on transfer roller 48 with circular projections 88 and 90 of core 62 out of contact with lower projections 21.

With dispensing roll 14*a* in its lower position, sensing plate 26 is pushed back to its position in nearly parallel alignment with back wall 6, thereby lowering pins 30. As pins 30 are lowered, they eventually contact the lower end of slot 154 and move retaining plates 150 downwardly and forwardly into abutment with holding levers 16 forcing the levers back to their vertical position with the projections 18 and 21 extending into the channels 7*c* and 8*c* of guide tracks 7 and 8. After the forward edge of the flexible sheet material wound on dispensing roll 14*a* is threaded through input roller 50 and pinch roller 52, around feed roller 54 and between feed roller 54 and exit roller 56 and under the stripper bar, the second or reserve roll 14*b* is inserted into guide track 7, with circular projections 88 and 90 of core 62 resting on upper projections 18, as shown in FIG. 6.

FIG. 1 shows dispenser in its ordinary dispensing position after a certain amount of the flexible sheet material has been dispensed from dispensing roll 14*a*. The diameter of dispensing roll 14*a* has decreased so that its rotational axis has been lowered. Dispensing roll 14*a* no longer rests on transfer roller 48; rather its core 62 is lowered within guide tracks 7 and 8 so that circular projections 88 and 90 of core 62 rest on lower projections 21. In this normal dispensing position, only the free end portion of the flexible sheet material, and not the roll surface of roll 14*a*, contacts dispensing mechanism 70. Dispensing of the sheet material through dispensing mechanism 70 continues in this fashion. This position of roll 14*a* is referred to normal since most of the sheet material from roll 14*a* is dispensed with roll 14*a* supported in this position.

Figure 7:
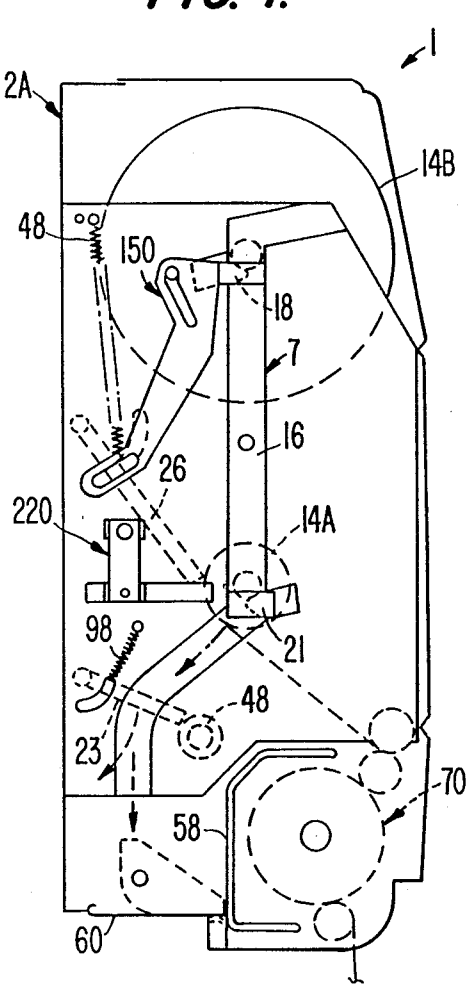
FIG. 7 is a diagrammatic side view showing the roll dispenser during normal operation with the dispensing roll nearly depleted and the full reserve roll in position.

FIG. 7 shows the situation in which dispensing roll 14*a* is nearly depleted so that sensing plate 26 has moved upwards but has not entirely cleared dispensing roll 14*a*. Pins 30 have also moved upwards, but since the pins 30 have not yet contacted the upper ends of slots 154, plates 150 has not yet moved out of abutment with holding levers 16. As long as there is enough sheet material wound on core 62 of dispensing roll 14*a* to prevent sensing plate 26 from clearing it, dispensing roll 14*a* and reserve roll 14*b* will remain in the positions held by projections 18 and 21. When the diameter of dispensing roll 14*a* is sufficiently reduced to a predetermined diameter so that sensing plate 26 clears it, pins 30 will contact the upper ends of slots 154 so that the continued upward movement of plate 26 moves plates 150 out of contact with holding levers 16 thus allowing holding lever 16 to rotate under the force of the weight of reserve roll 14*b*. Projections 18 and 21 will rotate out of channels 7*c* and 8*c* in guide tracks 7 and 8, allowing core 62 of dispensing roll 14*a* to roll down lateral portion 13, depositing dispensing roll 14a onto a guide plate 23. Reserve roll 14b drops downwardly in guide track 7 and the weight thereof pushes dispensing roll 14a to pivot plate 23 downward against the bias of a spring 98 connected between plate 23 and one of the sidewalls. Dispensing roll 14a thus drops into the temporary roll storage position located behind shield 58 and below plate 23.

FIG. 8 shows dispenser 1 after rolls 14a and 14b have dropped. Initially, reserve roll 14b is supported on transfer roller 48 on top of the remainder of the flexible sheet material from dispensing roll 14a. The action of the remaining flexible sheet material from dispensing roll 14a being fed through dispensing mechanism 70 automatically threads the forward edge of the flexible sheet material from reserve roll 14b through dispensing mechanism 70. At this stage, reserve roll 14b is supported on transfer roller 48 with core 62 out of contact with projections 21. Two-plies of sheet material will continue to be dispensed until the remaining sheet material from dispensing roll 14a is completely depleted. Eventually, the diameter of reserve roll 14b will be reduced sufficiently so that it will be supported by projections 21 with the roll surface of roll 14b losing contact with transfer roller 48.

Dispenser 1 thus automatically transfers a new full roll of sheet material into a position for dispensing after substantially all the sheet material has been dispensed from an initial roll, and automatically initiates the feeding of the sheet material from the second roll. Furthermore, dispenser 1 accomplishes this automatic transfer and feeding initiation in a manner that reduces the likelihood of jamming the dispensing mechanism. Guide tracks 7 and 8 are located so that their lower ends position the roll surface of the dispensing roll, both when it is resting on transfer roller 48 and supported on projections 21, out of contact with any of the rollers of dispensing mechanism 70. With the roll surface of out of contact with the rollers of the dispensing mechanism, rotation of the rollers of the dispensing mechanism does not necessarily result in rotation of the roll of sheet material. Thus, if a loop of material unwinds because of overspin of the dispensing roll, the loop does not increase with successive pulling of the material through dispensing mechanism 70, since the roll surface of sheet material is not rotated by the rollers of the dispensing mechanism and thus will not rotate until the loop has been pulled through dispensing mechanism 70.

Jamming is further prevented by locating shield 58 in the area between transfer roller 48, the lower end of guide tracks 7 and 8 and the rollers of dispensing mechanism 70 so that a loop of material which may occur because of overspin is prevented from contacting the rollers of dispensing mechanism 70.

The problem of uneven dispensing from a soft roll of material, which can occur when the roll must rest on its roll surface throughout the sheet material dispensing process is likewise alleviated. In dispenser 1, the dispensing roll rests on its outer surface for only a short period of time, and thereafter is supported at a fixed rotational axis by projections 21.

Figure 1A:
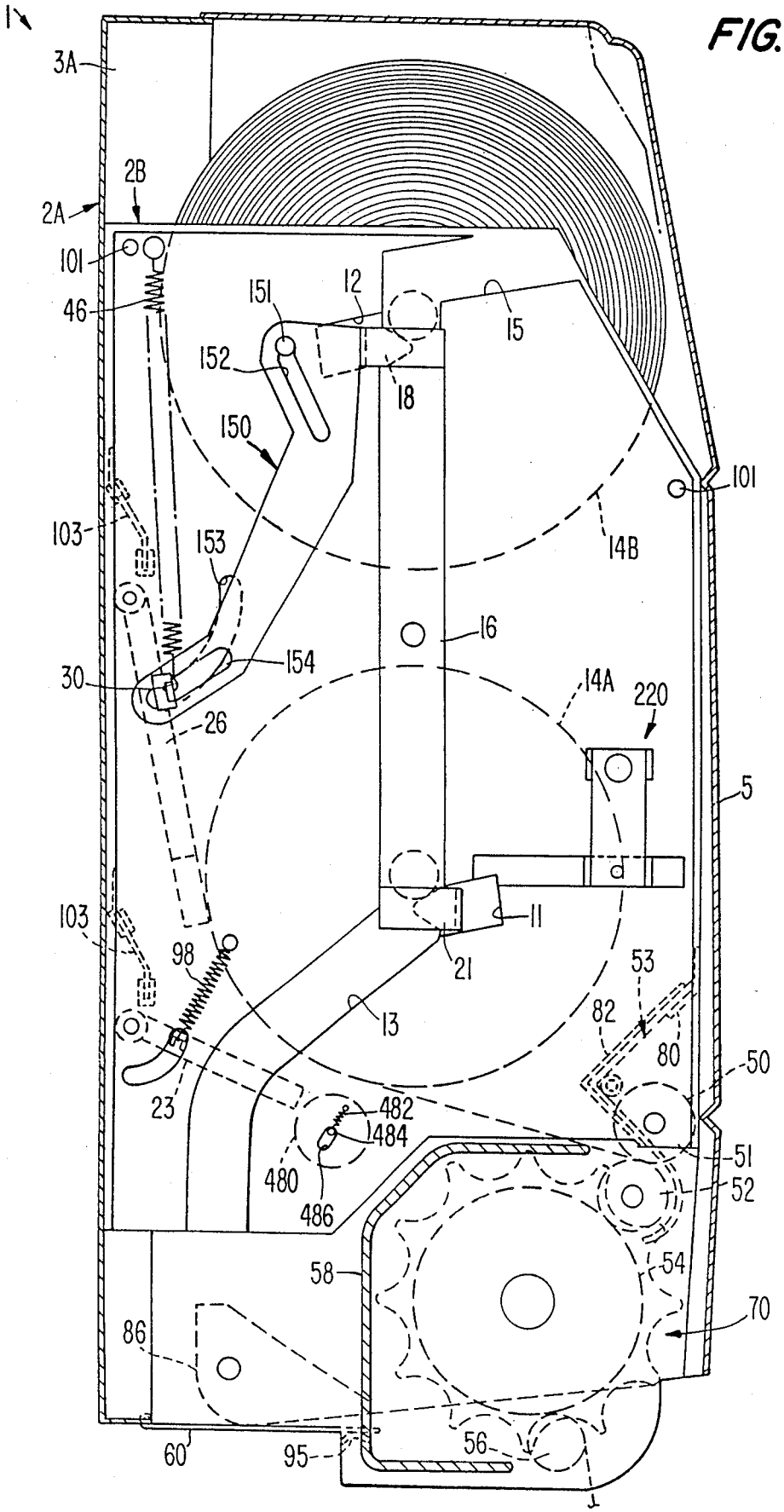
FIG. 1A illustrates an alternate way of placing the transfer roller in contact with the dispensing roll.

FIG. 1A illustrates a dispenser 1 with an alternate form of transfer roller and a repositioned brake mechanism. The dispenser of FIG. 1A uses a transfer roller 480 which is movably connected to sidewalls 3b and 4b and is biased upward by springs 482 coupled between the sidewalls and a rod 484 extending from the ends of roller 480. The ends of rods 484 extend through slots 486 in sidewall 3b, 4b. With transfer roller 480, dispensing roll 14a and reserve roll 14b are supported by lower projection 21 of holding levers 16 when they are initially dropped to a dispensing position until they are dropped into the core storage area. Transfer roller 480 thus does not support roll 14a or 14b. However, roller 480 is biased into contact with a full roll 14 and remains in contact with the outer surface of roll 14 until a predetermined amount of sheet material has been dispensed and the diameter of roll 14 has been reduced a sufficient amount so that roller 480 has reached its uppermost position. The biasing of roller 480 into contact with a full roll 14 assures that dispensing of sheet material from the full roll 14 is automatically initiated in the same manner as accomplished by transfer roller 48 of dispenser 1.

Figure 3:
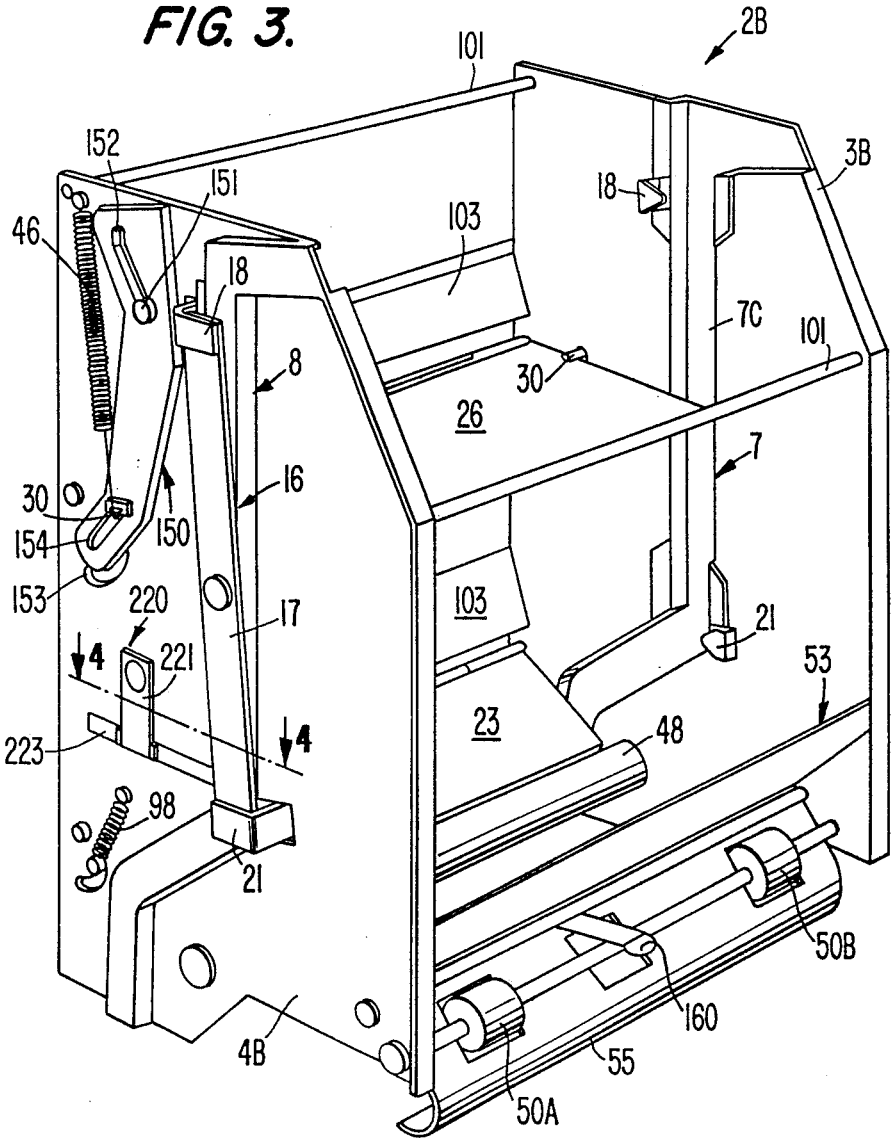
FIG. 3 is a perspective view of an internal housing with a roll guiding and transfer mechanism according to the present invention.

The brake mechanism 220, which is illustrated in FIG. 1A is the same type of brake element as illustrated in FIGS. 1, 3 and 4, however, it is repositioned to the front of dispenser 1. It has been found that this front positioning of brake mechanism 220 keeps a roll 14 better positioned in the guide tracks as the diameter of the roll becomes relatively small.

Figure 1B:
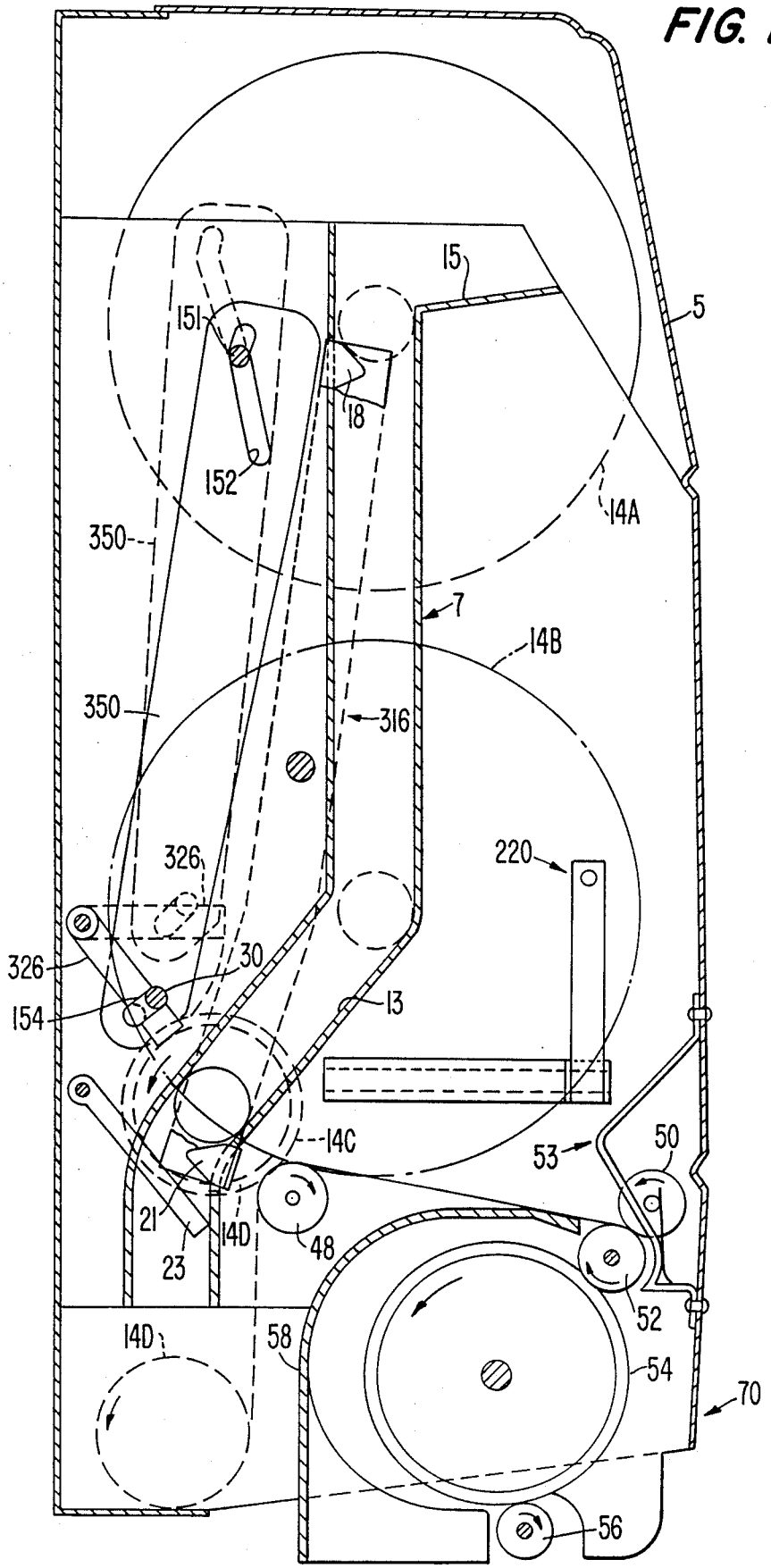
FIG. 1B illustrates an alternate arrangement of the transfer roller and the lower projections of the holding levers wherein the transfer roller, supports the dispensing roll over a major portion of the dispensing process.

FIG. 1B illustrates a dispenser 1 with an alternate form of holding levers 316, sensing plate 326 and retaining plate 350. The length of each holding lever 316 is extended and its lower portion is angled in the direction of the slant of lower lateral portion 13 of guide tracks 7. In this manner, lower projection 21 of holding lever 316 is located at a lower location along guide track 7 than projection 21 of holding lever 16, and a dispensing roll 14b is supported on transfer roller 48 while a major portion of the sheet material is dispensed. As seen in FIG. 1B, transfer roller 48 supports the dispensing roll until its diameter is reduced to 14c. The reduced diameter dispensing roll is thereafter supported by lower projections 21 until its diameter is further reduced to 14d. At the diameter 14d a certain amount of sheet material remains on the dispensing roll and sensing plate 326 moves from a position in contact with the dispensing roll (shown in full line) to an upper horizontal position (shown in dash line). The upward motion of sensing plate 326 moves retaining plate 350 from its support position against holding lever to its release position, shown in phantom line, wherein reserve roll 14a is free to move downwardly along guide track 7.

To accommodate the extended length of holding levers 316 and the resultant lowered position of lower projections 21 sensing plate 326 is shortened and repositioned, from the length and positioning of sensing plate 26 and retaining plate 350 is lengthened and reshaped from the length and shape of retaining plate 150.

FIGS. 20 to 30 illustrate a second embodiment of dispenser 1'. Where appropriate elements of dispenser 1' which are similar to elements of dispenser 1 will be indicated by like-primed numerals.

Dispenser 1' includes a housing 2' for holding multiple rolls of sheet material, such as paper towel and the like, wound over cores. Housing 2' includes an external housing 2a' and an internal housing 2b' attached inside external housing 2a'. The rolls are supported and guided through housing 2' by guide tracks 7' and 8', and a pivotable holding lever 16'. The pivoting of holding lever 16' in turn is controlled by a sensing/retainer plate mechanism. Sheet material is dispensed from dispenser 1' through a dispensing or feed mechanism 70'.

Figure 28:
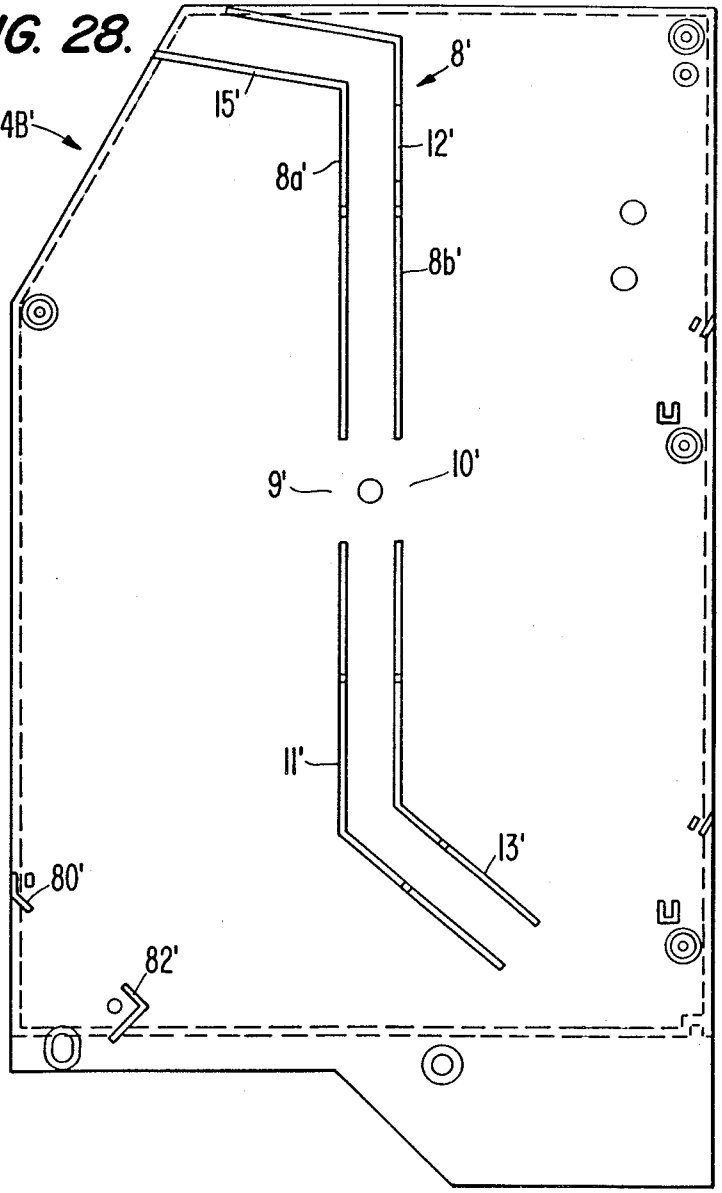
FIG. 28 is a view of the other side of the internal housing of the second embodiment roll dispenser.
Figure 27:
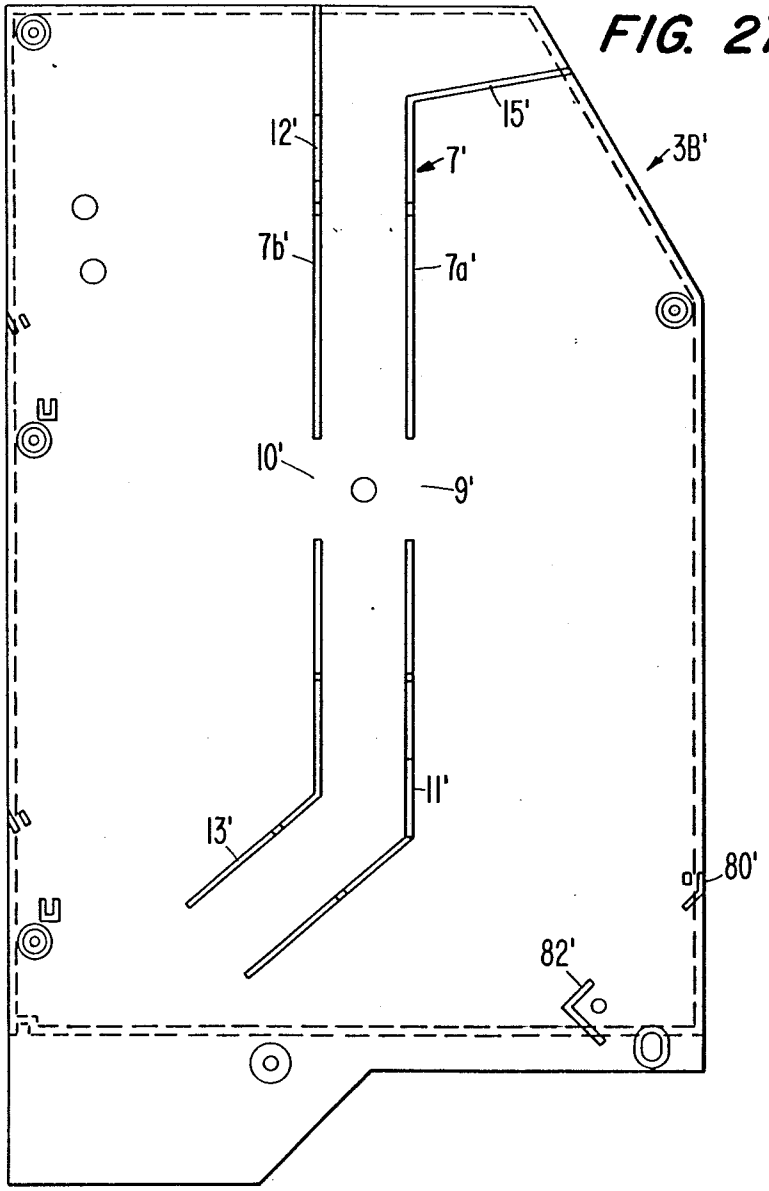
FIG. 27 is a view of one side of the internal housing of the second embodiment roll dispenser.

External housing 2a' includes a front cover 5', sidewalls 3a' and 4a' and a back wall 6'. Internal housing 2b' includes sidewalls 3b' and 4b' held together in a spaced, parallel relationship by a plurality of rods 101, plates 103 and portions of dispensing mechanism 70. FIG. 27 shows right sidewall 3b and FIG. 28 shows left sidewall 4b, with the orientation of the system being determined by facing the front of housing 2'. Guide track 7' is attached to right sidewall 3b' and guide track 8' is attached to left sidewall 4b'. As with dispenser 1, the components of dispenser 1' will only be discussed with respect to one side, with the understanding that a like component is located on the other side of dispenser 1', unless otherwise indicated.

Guide track 7' includes opposed sidewalls 7a' and 7b' forming a central channel 7c'. Guide track 7' is orientated substantially vertically with the exception of a lower lateral portion 13' which extends downward towards back wall 6', and an upper lateral portion 15' of wall 7c' which extends upward toward cover 5. Lateral sidewalls 7a' and 7b' include openings 9' and 10' at a mid-portion along their lengths. Openings 9' and 10' extend completely to housing sidewall 3', so that guide track 7' is discontinuous at these areas. Additionally, a lower opening 11' extends partially through lateral sidewall 7a' at the bottom of the vertical portion of guide track 7' where it meets lower lateral portion 13', and an upper opening 12' extends partially through opposite lateral sidewall 7b' near an upper portion of guide track 7'.

A holding lever 16' includes an upper vertical portion 17', a horizontal mid-portion 19', and a lower vertical portion 20'. Upper vertical portion 17' extends from opening 10' in guide track 7' towards the top of dispenser 1' and lower vertical portion 20' extends from opening 9' towards the bottom of guide track 7'. Mid-portion 19' fits through openings 9' and 10' of guide track 7' and is pivotably attached to sidewall 3b' by a fastener such as a screw. An upper projection 18' extends from upper vertical portion 17' and a lower projection 21' extends from lower vertical portion 20'. When mid-portion 19' is disposed horizontally, upper projection 18' extends through opening 12' into channel 7c' and lower projection 21' extends through opening 11' into channel 7c'. A flat spring brake 22' is fixed to sidewall 3' at location slightly above projection 21' to bear against the outer edge of the sheet material on dispensing roll 14a and prevent excessive over spinning due to sudden stops while dispensing.

A sensing plate 26' extends along back wall 6' and is pivotably attached to each of the sidewalls 3b', 4b' along an axis adjacent back wall 6'. A spring 46' is connected to one sidewall and to a side of sensing plate 26' to bias it upward against the outer surface of the sheet material on dispensing roll 14a'. The upper surface of sensing plate 26' adjacent each of its sides includes a projection tab 30' with a center hole 33'. A slotted link 34' includes a lower tab portion 31' offset from the remaining portion of link 33' with a hole extending through it. Slotted link 34' is connected to sensing plate 26' by a screw 35' extending through the holes in tab 30' and lower tab portion 31'. A slot 36' is formed in the upper end of slotted link 34'. A retaining plate 150' is pivotably mounted to sidewall 3b' by a pin extending from the wall, and a bolt 40' extends through slot 36' and into a hole in retaining plate 150' to slidably couple slotted link 34' to plate 150'. The forward end of plate 150' is rounded and bears against upper vertical portion 17' of holding lever 16' when rolls 14' are to be held in the position shown in FIG. 20.

A transfer roller 48' is rotatably mounted between the opposing sidewalls below dispensing roll 14a'. Dispensing mechanism 70', located near cover 5', includes an input roller 50', a pinch roller 52', a feed roller 54' and an exit roller 56'. Input roller 50' is comprised of a plurality of separate rollers 50a', 50b' and 50c' disposed across the width of dispenser 1' which rest on and are driven by separate pinch rollers 52a', 52b' and 52c' of pinch roller 52.

A transfer plate 53' also extends across the width of dispenser 1' and is secured to upper and lower brackets 80', 82' extending from sidewalls 3b', 4b'. Transfer plate 53' includes a loading end 51' and a curved lower end 55'. Loading end 51' guides the forward end of the sheet material between input roller 50' and pinch roller 52', and curved lower end 55' of transfer plate 53' guides the sheet material into the region between pinch roller 52' and feed roller 54'. Pinch roller 52' is spring loaded against feed roller 54' in a conventional manner. Exit roller 56' is located below feed roller 54' with a stripper bar 57' placed adjacent to both the feed and exit rollers. A cutting mechanism can also be incorporated in feed roller 54'. Feed roller 54' is surrounded by shield 58' which extends from an area adjacent exit roller 56', below feed roller 54', upwardly around the back of feed roller 54' and horizontally over the top of feed roller 54' to a location adjacent the intersection of input roller 50' and pinch roller 52'. A drop out door 60' extends from shield 58' towards back wall 6' and between sidewalls 3a' and 4a'.

Figure 2:
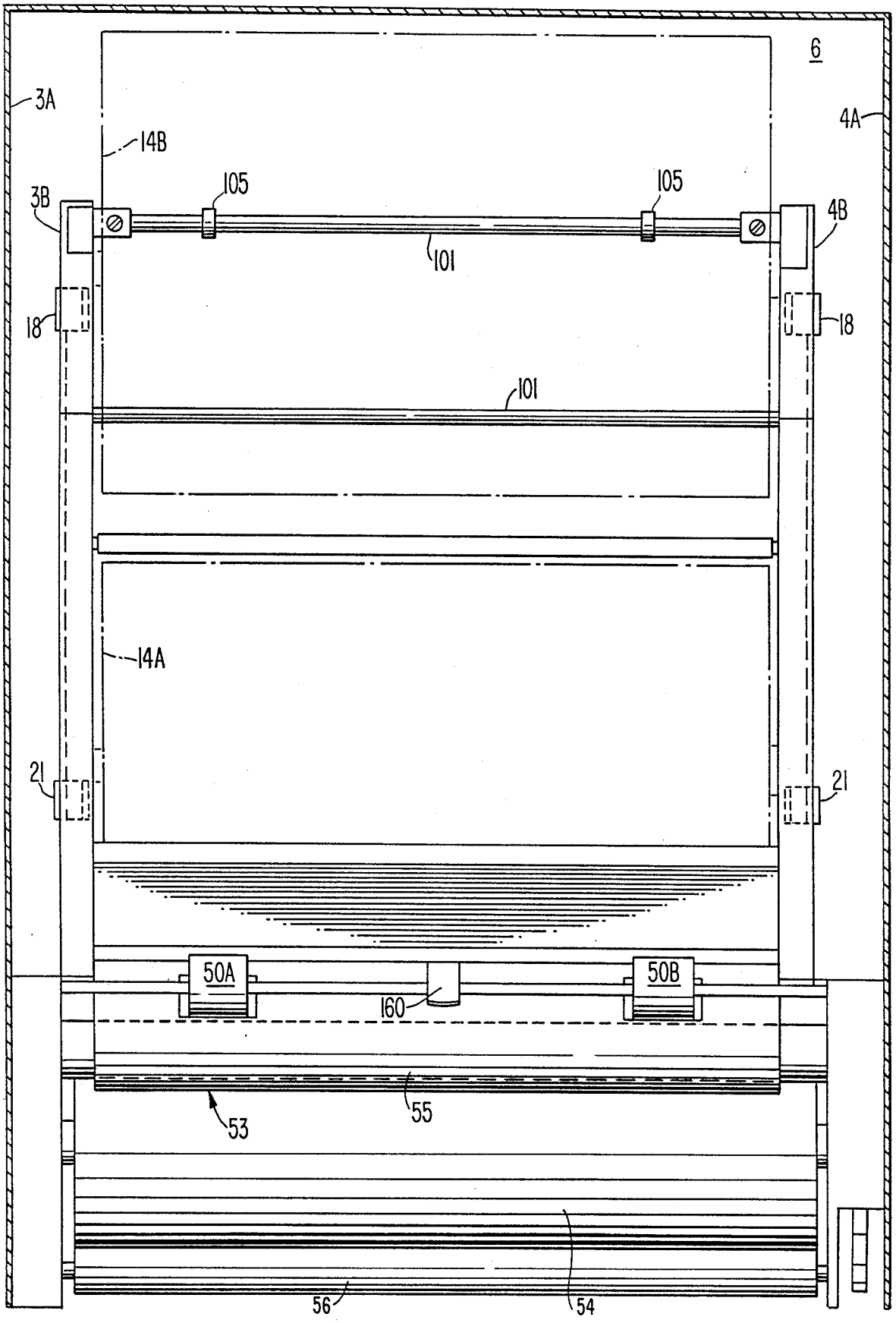
FIG. 2 is a cross-sectional view of the roll dispenser shown in FIG. 1 taken generally along lines 2—2 of FIG. 1.
Figure 23:
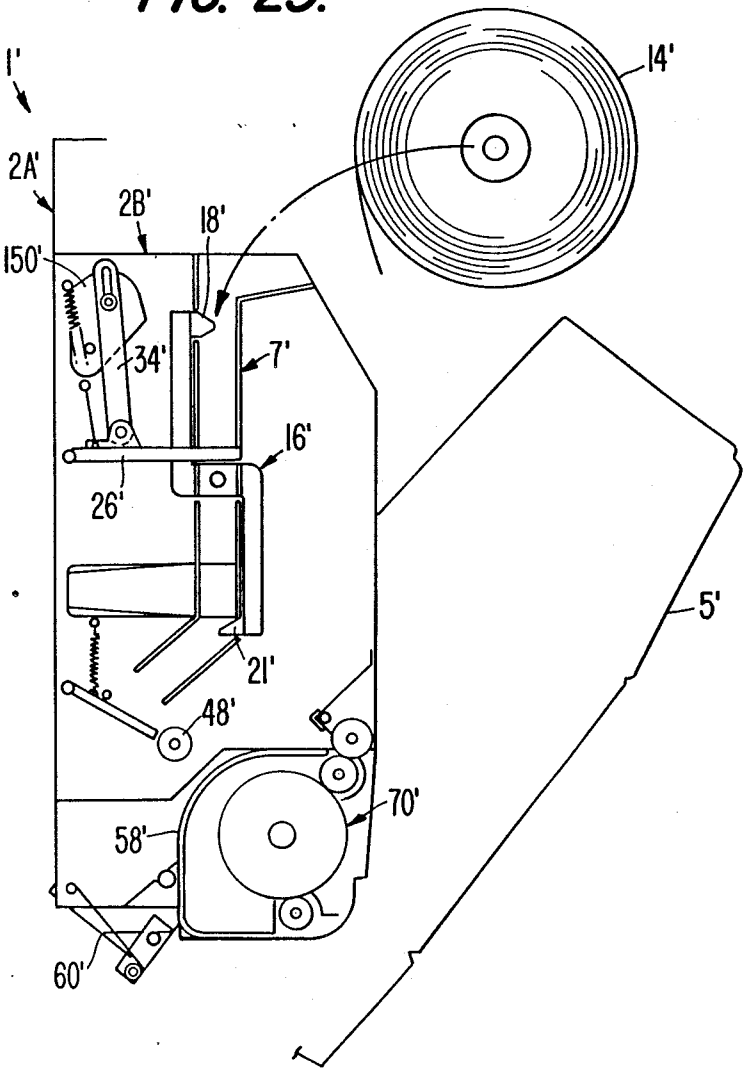
FIG. 23 is a diagrammatic side view illustrating a roll of sheet material being fed into an empty second embodiment roll dispenser with the cover of the dispenser in the open position.
Figure 29:
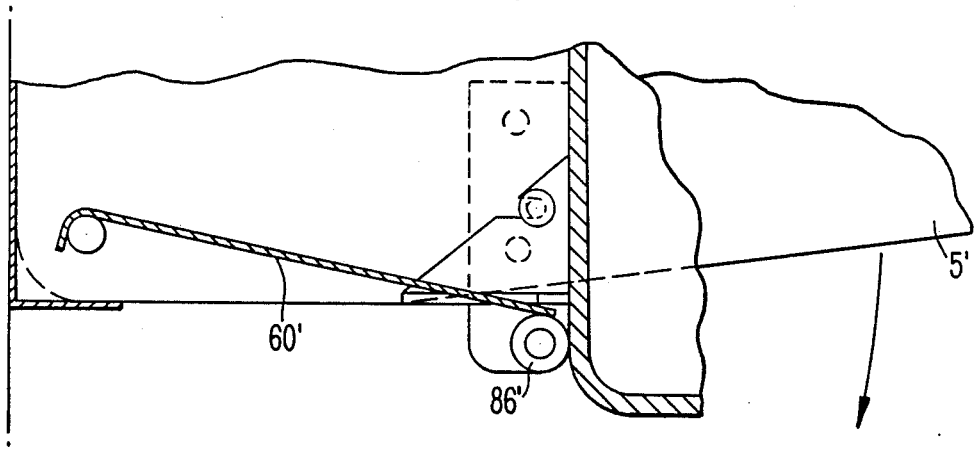
FIG. 29 is an enlarged view of a lower section of the second embodiment roll dispenser external housing according to the present invention.
Figure 30:
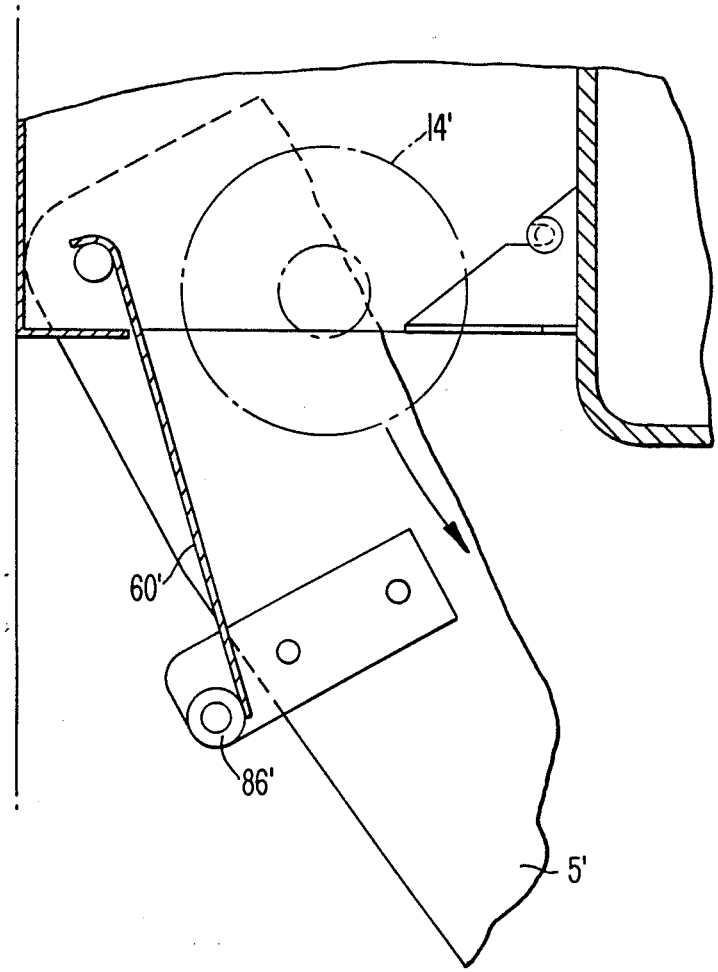
FIG. 30 is a view of the lower section of the second embodiment roll dispenser external housing shown in FIG. 10 with an empty core access door open.

FIGS. 20 and 23–26 are similar to FIGS. 1 and 5–7, and show the chronology of loading and dispensing of rolls of flexible sheet material from a pair of rolls 14a' and 14b' in dispenser 1'. As shown in FIGS. 2, 29, and 30 dispenser 1' is emptied by pivoting cover 5' which simultaneously lowers drop out door 60' by lowering door support flanges 86' attached to the sides of cover 5'. In this manner cores stored above door 60' are removed. With dispenser 1' empty as shown in FIG. 23, sensing plate 26' is free to move to its uppermost position due to the biasing provided by spring 46'. Therefore, slotted link 34' is pushed to its uppermost position, and the lower end of slot 36' contacts and pushes bolt 40' upward to move retaining plate 150' out of abutment with holding lever 16'.

Figure 24:
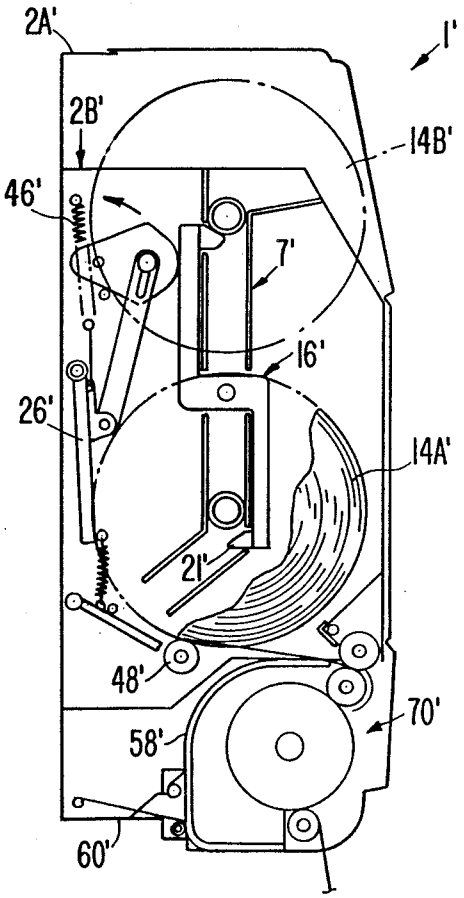
FIG. 24 is a diagrammatic side view showing the second embodiment roll dispenser with both a full reserve and a full dispensing roll inserted in the dispenser.

Dispensing roll 14a' is loaded into dispenser 1' by placing circular projections 88' and 90' of opposite core ends in upper portion 15' of the guide tracks. The weight of dispensing roll 14a' forces holding lever 16' to pivot out of channels 7c' and 8c' by contacting projections 18'. Circular projections 88' and 90' slide downwardly through channels 7c' and 8c' and through a channel 19c' formed by sidewalls 19a' and 19b' in mid-portion 19' of holding lever 16'. Roll 14a thus continues to move downwardly under the guidance of the guide tracks until the outer surface of dispensing roll 14a' contacts transfer roller 48', as shown in FIG. 24. As seen therein, lower projections 21' of holding lever 16' are spaced a predetermined vertical distance from transfer roller 48' so that a full dispensing roll 14a' rests on transfer roller 48' with circular projections 88' and 90' of core 62' out of contact with lower projections 21'.

With dispensing roll 14a' in its lower position, sensing plate 26' is pushed backed to its position in nearly parallel alignment with back wall 6', thereby lowering slotted link 34'. As slotted link 34' is lowered, the upper end of slot 36' eventually contacts bolt 40' to pivot retaining plate 150' downwardly into abutment with holding lever 16' forcing it back to its vertical position with the projections 18' and 21' extending into the channels 7c' and 8c' of guide tracks 7' and 8'. After the forward edge of the flexible sheet material wound on dispensing roll 14a' is threaded through input roller 50' and pinch roller 52', around feed roller 54' and between feed roller 54' and exit roller 56' and under stripper bar 47', the second or reserve roll 14b' is inserted into guide track 7', with circular projections 88' and 90' of core 62' resting on upper projections 18', as shown in FIG. 24.

Figure 20:
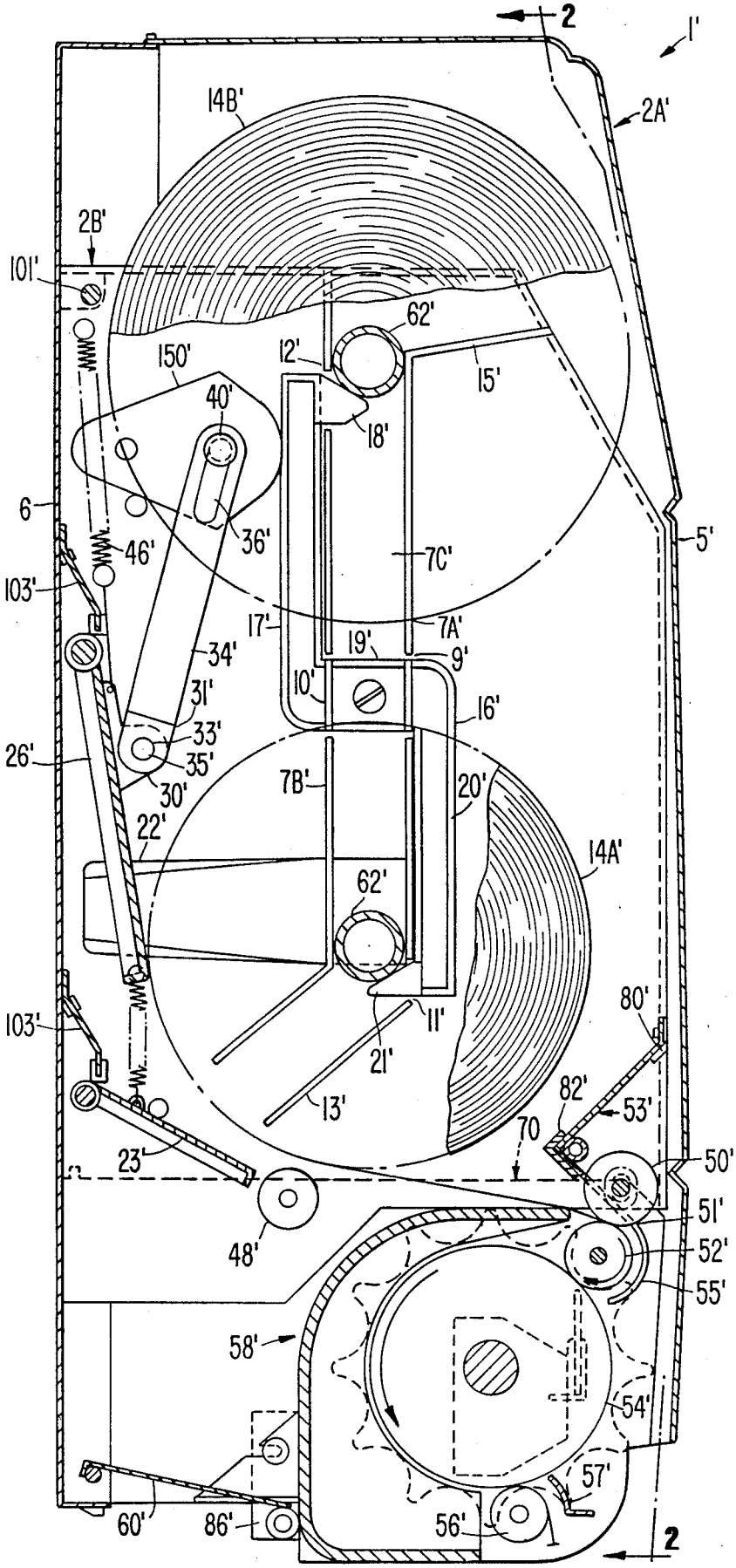
FIG. 20 is a side view, partially broken away and partially in section, of a second embodiment of roll dispenser according to the present invention showing a dispensing roll and a reserve roll in their normal positions during operation of the dispenser.
Figure 21:
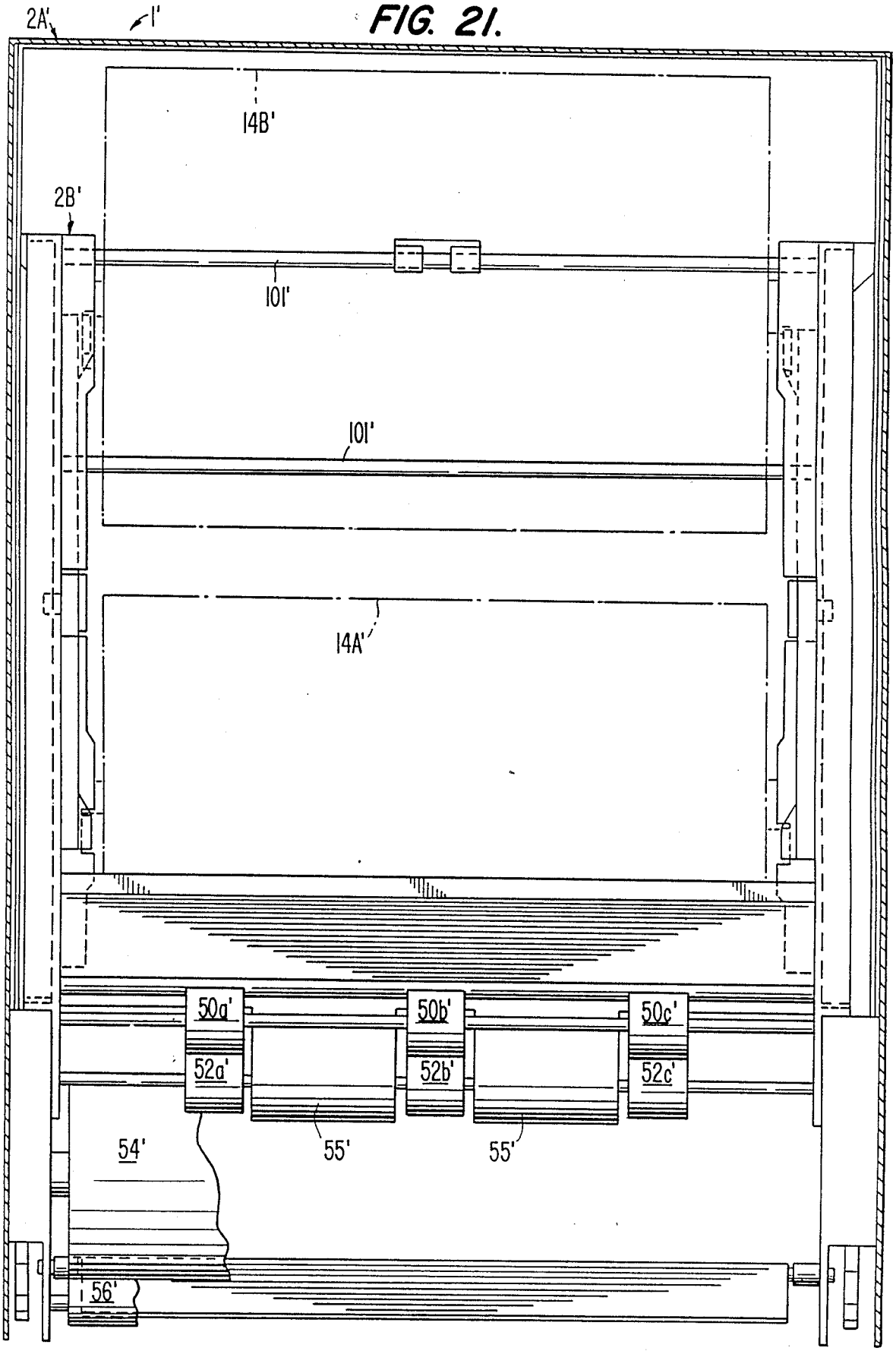
FIG. 21 is a cross-sectional view of the roll dispenser shown in FIG. 20 taken generally along lines 21—21 of FIG. 20.
Figure 22:
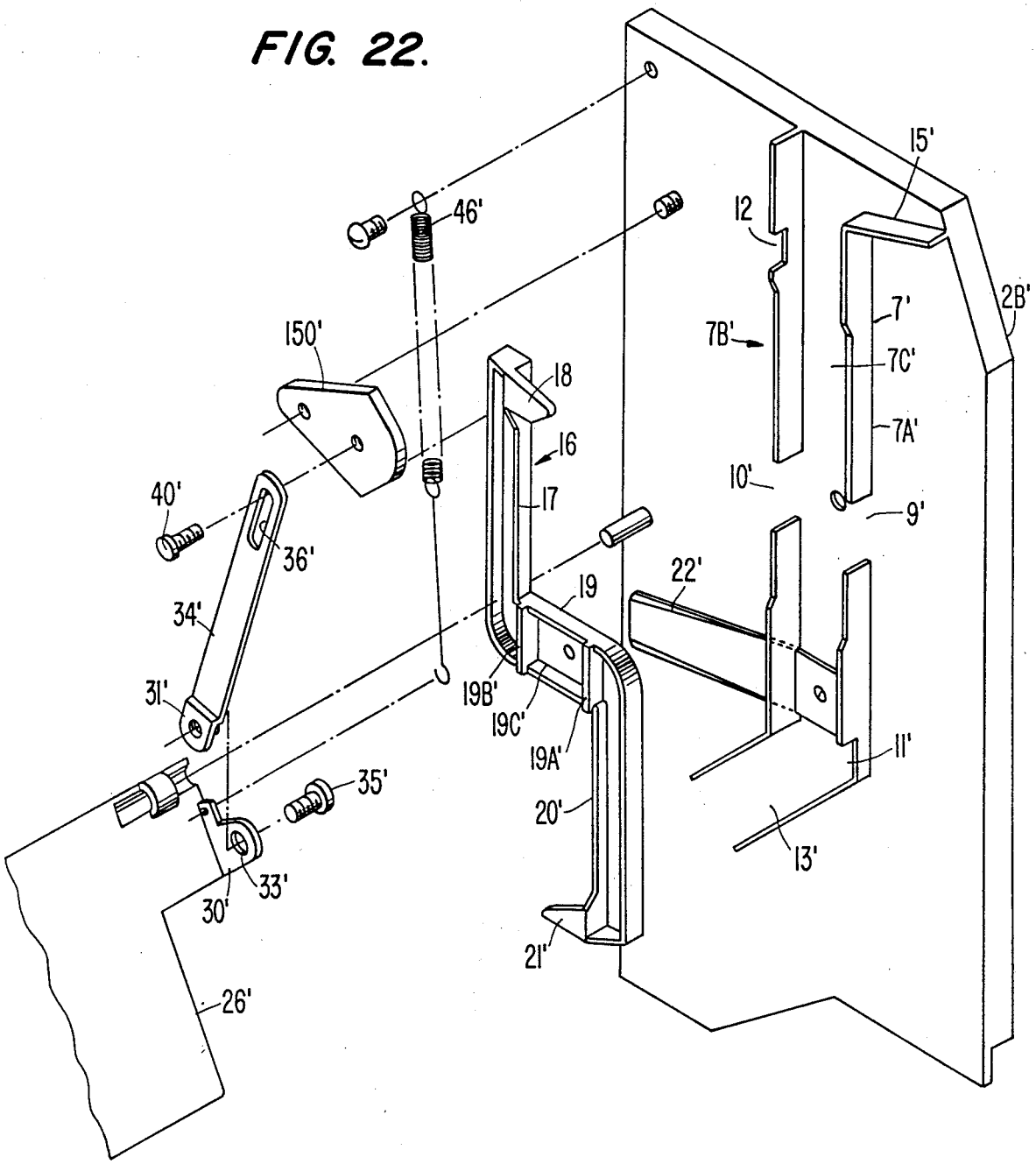
FIG. 22 is an exploded perspective view of a roll guiding and transfer mechanism according to the second embodiment of the present invention.

FIG. 20 shows dispenser in its ordinary dispensing position after a certain amount of the flexible sheet material has been dispensed from dispensing roll 14a'. The diameter of dispensing roll 14a' has decreased so that its rotational axis has been lowered. Dispensing roll 14a' no longer rests on transfer roller 48'; rather its core 62' is lowered within guide tracks 7' and 8' so that circular projections 88' and 90' core 62' rest on lower projections 21'. In this normal dispensing position, only the free end portion of the flexible sheet material, and not the roll surface of roll 14a', contacts dispensing mechanism 70'. Dispensing of the sheet material through dispensing mechanism 70' continues in this fashion.

Figure 25:
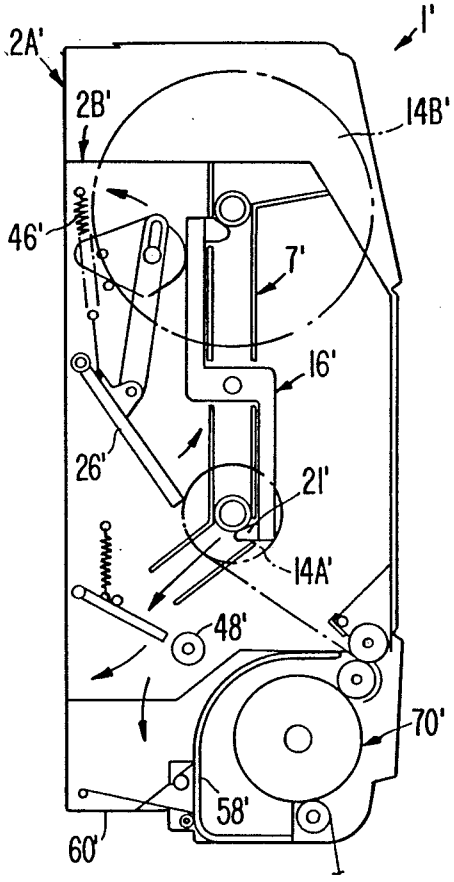
FIG. 25 is a diagrammatic side view showing the second embodiment roll dispenser during normal operation with the dispensing roll nearly depleted and the full reserve roll in position.

FIG. 25 shows the situation in which dispensing roll 14a' is nearly depleted so that sensing plate 26' has moved upwards but has not entirely cleared dispensing roll 14a'. Slotted link 34' has also moved upwards, but due to movement of projection 40' of plate 150' within slot 36', plate 150' has not yet moved out of abutment with holding lever 16'. As long as there is enough sheet material wound on core 62' of dispensing roll 14a' to prevent sensing plate 26' from clearing it, dispensing roll 14a' and reserve roll 14b' will remain in the positions held by projections 18' and 21'. When the diameter of dispensing roll 14a' is sufficiently reduced so that sensing plate 26' clears it, the lower end of slot 36' will contact projection 40' so that the continued upward movement of link 34' pivots plate 150' out of contact with holding lever 16' thus allowing holding lever 16' to rotate under the force of the weight of reserve roll 14b'. Projections 18' and 21' will rotate out of channels 7c' and 8c' in guide tracks 7' and 8', allowing core 62' of dispensing roll 14a' to roll down lateral portion 13', depositing dispensing roll 14a' onto guide plate 23'. Reserve roll 14b' drops downwardly in guide track 7' and the weight thereof pushes dispensing roll 14a' to pivot plate 23' downward against the bias of a spring 96 connected between plate 23' and the sidewall, and allow dispensing roll 14a' to drop into the temporary roll storage position located behind shield 58' and below plate 23'.

Figure 26:
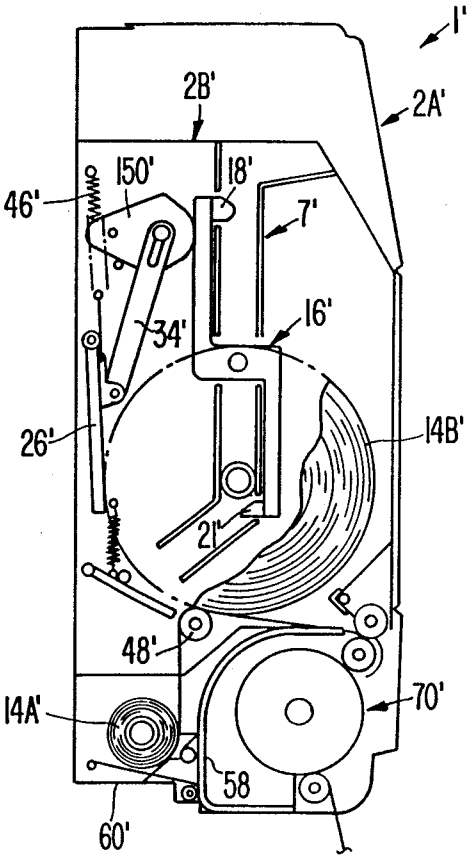
FIG. 26 is a diagrammatic side view showing the second embodiment roll dispenser with the reserve roll lowered to rest on a transfer roller and being fed through the dispenser together with the remaining material from the dispensing roll held in a storage mechanism.

FIG. 26 shows dispenser 1' after rolls 14a' and 14b' have dropped. Initially, reserve roll 14b' is supported on transfer roller 48' on top of the remainder of the flexible sheet material from dispensing roll 14a'. The action of the remaining flexible sheet material from dispensing roll 14a' being fed through feed mechanism 70' automatically threads the forward edge of the flexible sheet material from reserve roll 14b' through dispensing mechanism 70'. At this stage, reserve roll 14b' is supported on transfer roller 48' with core 62' out of contact with projections 21'. Two-plies of sheet material will continue to be dispensed until the remaining sheet material from dispensing roll 14a' is completely depleted. Eventually, the diameter of reserve roll 14b' will be reduced sufficiently so that it will be supported by projections 21' with the roll surface of roll 14b' losing contact with support roller 48'.

The invention has been described in detail in connection with preferred embodiments. The preferred embodiments, however, are merely for example only and this invention is not restricted thereto. It would be easily understood by those skilled in the art that variations and modifications can be easily made within this scope of this invention as defined by the appended claims.

What is claimed is:

1. A dispenser for rolls of flexible sheet material wound on cores, the cores having ends extending beyond the sides of the rolls, the dispenser comprising:

a housing having opposite sidewalls, each sidewall having a guide track comprising a substantially vertical channel formed between lateral walls for receiving and guiding the core ends;

a substantially vertically disposed holding lever pivotably attached to each sidewall, said holding levers including an upper projection adjacent an upper end of said guide track for retaining a reserve roll of flexible sheet material at an upper reserve position along said guide track and a lower projection adjacent a lower end of said guide track for retaining a dispensing roll of flexible material at a lower position along said guide track;

a transfer roller supported in said housing adjacent the lower end of said guide track for contacting a roll of sheet material during a portion of the dispensing of the sheet material from the dispenser; and dispensing means including at least one roller supported in said housing adjacent the dispensing roll and laterally of said transfer roller for dispensing sheet material from the dispensing roll and out of said dispenser;

said transfer roller and said lower projections of said holding levers being located in said housing a predetermined distance from one another so that said transfer roller contacts the roll surface of a dispensing roll until a predetermined amount of sheet material is dispensed from the dispensing roll, said lower end of said guide tracks being positioned with respect to said dispensing means to locate the dispensing roll out of contact with rollers of said dispensing means.

2. A dispenser for rolls of flexible sheet material wound on cores, the cores having ends extending beyond the sides of the rolls, the dispenser comprising:

a housing having opposite sidewalls, each sidewall having a guide track comprising a substantially vertical channel formed between lateral walls for receiving and guiding the core ends;

a substantially vertically disposed holding lever pivotably attached to each sidewall said holding levers including an upper projection adjacent an upper end of said guide track for retaining a reserve roll of flexible sheet material at an upper reserve position along said guide track and a lower projection adjacent a lower end of said guide track for retaining a dispensing roll of flexible material at a lower position along said guide track;

a transfer roller supported in said housing adjacent the lower end of said guide track for contacting a roll of flexible sheet material during a portion of the dispensing of the sheet material from the dispenser;

dispensing means supported in said housing adjacent the dispensing roll and laterally of said transfer roller for dispensing sheet material from the dispensing roll and out of said dispenser, said dispensing means including at least a feed roller and means for urging sheet material from the dispensing roll into contact with said feed roller;

said transfer roller and said lower projections of said holding levers being located in said housing a predetermined distance from one another so that said transfer roller contacts a dispensing roll until a predetermined amount of sheet material is dispensed from the dispensing roll, said lower end of said guide tracks being positioned with respect to said dispensing means to locate the dispensing roll out of contact with rollers of said dispensing means;

a shield disposed in said housing around said feed roller, said shield being located between said feed roller and a dispensing roll to prevent contact of the sheet material from the dispensing roll with the feed roller prior to said urging means urging the sheet material into contact with said feed roller;

sensing means for sensing the reducing diameter of the dispensing roll as sheet material is dispensed from the dispensing roll;

release means for releasing said holding levers to allow the levers to pivot from a holding position in which the upper and lower projections are positioned to hold rolls of sheet material to a release position in which the rolls are free to move downwardly along the said guide tracks;

coupling means for coupling said sensing means to said release means to activate said release means when the diameter of the dispensing roll has been reduced a predetermined amount so that the dispensing roll is substantially depleted but has a remaining length of sheet material; and said housing including storage means for holding a substantially depleted dispensing roll after the holding levers are allowed to pivot to the release position, said storage means being located in said housing with respect to said transfer roller so that the remaining length of sheet material from the roll in said storage means remains in contact with the transfer roller to thereby contact and simultaneously feed sheet material from a reserve roll which has been released from the upper reserve position.

3. A dispenser as recited in claim 1 wherein said transfer roller is rotatably supported at a fixed position in said housing for supporting a roll of flexible sheet material at a sheet dispensing position, said fixed position of said transfer roller and said lower projections of said holding levers being located in said housing a predetermined distance from one another so that a dispensing roll is supported by said transfer roller at said sheet dispensing position with its core ends above and out of contact with said lower projections until the predetermined amount of sheet material is dispensed from the dispensing roll, the predetermined amount of sheet material comprising a major portion of the sheet material to be dispensed from a roll.

4. A dispenser as recited in claim 2 wherein said transfer roller is rotatably supported at a fixed position in said housing for supporting a roll of flexible sheet material at a sheet dispensing position, said fixed position of said transfer roller and said lower projections of said holding levers being located in said housing a predetermined distance from one another so that a dispensing roll is supported by said transfer roller at said sheet dispensing position with its core ends above and out of contact with said lower projections until the predetermined amount of sheet material is dispensed from the dispensing roll, the predetermined amount of sheet material comprising a major portion of the sheet material to be dispensed from a roll.

5. A dispenser as recited in claim 3 including sensing means for sensing the reducing diameter of the dispensing roll as sheet material is dispensed from the dispensing roll, and release means for releasing said holding levers to allow the lever to pivot from a holding position in which the upper and lower projections are positioned to hold rolls of sheet material in to a release position in which the reserve and dispensing rolls are free to move downwardly along the said guide tracks, coupling means for coupling said sensing means to said release means to activate said release means when the diameter of the dispensing roll has been reduced an amount so that the dispensing roll is substantially depleted but has a remaining length of sheet material, said housing including storage means for holding a substantially depleted dispensing roll after the holding levers are allowed to pivot to the release position, said storage means being located in said housing with respect to said transfer roller so that the remaining length of sheet material from the roll in said storage means remains in contact with the transfer roller to thereby contact and simultaneously feed sheet material from a reserve roll which has been released from the upper reserve position.

6. A dispenser as recited in claim 4 wherein said sensing means includes a sensing plate pivotably supported in said housing, means for biasing said sensing plate against the sheet material on the dispensing roll, and said release means includes at least one retaining plate movably mounted in said housing and movable between a position in contact with said holding levers and a position out of contact with said holding levers.

7. A dispenser as recited in claim 5 wherein said sensing means includes a sensing plate pivotably supported in said housing, means for biasing said sensing plate against the sheet material on the dispensing roll, and said release means includes at least one retaining plate movably mounted in said housing and movable between a position in contact with said holding levers and a position out of contact with said holding levers.

8. A dispenser as recited in claim 7 wherein said retaining plate is pivotably supported in said housing.

9. A dispenser as recited in claim 8 wherein said coupling means includes at least one connecting link connected between said sensing plate and said at least one retaining plate.

10. A dispenser as recited in claim 9 wherein said means for biasing said sensing plate applies said bias in an upward direction to move said at least one connecting link upwardly as sheet material is dispensed from said dispensing roll, said at least one connecting link having an upper end connected to said at least one retaining plate through a slotted connection that allows said at least one link to move upwardly without pivoting said at least one retaining plate out of contact with said holding levers until the diameter of said dispensing roll has been reduced said predetermined amount.

11. A dispenser as recited in claim 10 wherein said retaining means includes one of said retaining plates pivotably connected to each of said sidewalls, and said coupling means includes one of said connecting links coupled to each of said retaining plates, said slotted connection including a slot formed in the upper end of each of said connecting links and a projection extending from each said retaining plates into each of said slots.

12. A dispenser as recited in claim 7 wherein said retaining plate is vertically and horizontally movable along at least one of said sidewalls.

13. A dispenser as recited in claim 12 wherein said coupling means includes a projection extending from said sensing plate and received in an elongate slot formed in said retaining plate.

14. A dispenser as recited in claim 13 wherein said retaining means includes one of said retaining plates movably coupled to each of said sidewalls, each of said retaining plates having a second elongate slot, and a guide pin extending from each of said sidewalls into a respective one of said retaining plates to guide the motion of the retaining plates.

15. A dispenser as recited in claim 3 wherein said dispensing means includes a feed roller and means for urging sheet material from the dispensing roll into contact with said feed roller, and a shield disposed in said housing around said feed roller, said shield being located between said feed roller and a dispensing roll to prevent contact of the sheet material from the dispensing roll with the feed roller prior to said urging means urging the sheet material into contact with said feed roller.

16. A dispenser as recited in claim 4 wherein said urging means comprises a pinch roller biased into contact with said feed roller at a feed nip.

17. A dispenser as recited in claim 16 wherein said dispensing means further includes an input roller supported immediately adjacent said pinch roller and a transfer plate surrounding a portion of said input roller to guide the sheet material to said feed nip.

18. A dispenser recited in claim 17 wherein an upper surface of said shield is located in the area between said transfer roller and an inlet nip between said input and pinch rollers to guide the sheet material to said inlet nip.

19. A dispenser as recited in claim 18 wherein said transfer plate has a loading end adjacent said inlet nip to guide sheet material to said inlet nip and a curved lower end to guide sheet material to said feed nip.

20. A dispenser as recited in claim 3 or 4 wherein an upper opening is formed in one of the lateral sidewalls of each guide track adjacent its upper end and a lower opening is formed in one of the lateral sidewalls of each guide track adjacent its lower end, the upper projections of said holding levers passing through said upper openings into said channels of said guide tracks and the lower projections of said holding levers passing through said lower openings into said channels of said guide tracks.

21. A dispenser as recited in claim 20 wherein each of said holding levers includes an upper generally vertically extending section, a lower generally vertically extending section and mid-section extending generally horizontally between said upper and lower sections.

22. A dispenser as recited in claim 21 wherein the lateral wall of each of said guide tracks includes a gap through which said mid-section of said holding levers extends to dispose said upper and lower sections of said holding levers on opposite sides of each respective guide track.

23. A dispenser as recited in claim 20 wherein said housing includes an exterior housing and a interior housing supported in said exterior housing, and each of said sidewalls being formed as a portion of said interior housing.

24. A dispenser as recited in claim 3 or 4 wherein said housing includes an exterior housing and a interior housing supported in said exterior housing, and each of said sidewalls being formed as a portion of said interior housing.

25. A dispenser as recited in claim 24 wherein an upper opening is formed in one of the lateral sidewalls of each guide track adjacent its upper end and a lower opening is formed in one of the lateral sidewalls of each guide track adjacent its lower end, the upper projections of said holding levers passing through said upper openings into said channels of said guide tracks and the lower projections of said holding levers passing through said lower openings into said channels of said guide tracks.

26. A dispenser as recited in claim 25 wherein each guide track is formed in an inner facing surface of said sidewalls and each holding lever is pivotably mounted to an outer surface of said sidewalls.

27. A dispenser as recited in claim 3 or 4 including braking means for engaging a dispensing roll of sheet material and reducing the tendency of the dispensing roll to overspin during dispensing of the sheet material, said braking means including a brake plate coupled to at least one of said sidewalls and biased into engagement with a side of the dispensing roll of sheet material, said brake plate being shaped to reduce to amount of braking force as the diameter of the dispensing roll approaches a minimum diameter.

28. A method for dispensing sheet material from a dispenser wherein the sheet material is wrapped in a roll about a core and the sheet material is dispensed from the dispenser through a dispensing mechanism including at least one feed roller, comprising the steps of:

supporting a dispensing roll of the sheet material in the dispenser with the roll surface of the roll in contact with a transfer roller and out of contact with rollers of the dispensing mechanism;

dispensing sheet material from the roll through the dispensing mechanism to diminish the diameter of the supported dispensing roll;

supporting the dispensing roll of sheet material at a constant axis during portion of the dispensing of the sheet material by holding the core of the dispensing roll at a fixed vertical position so that the roll surface of the dispensing roll remains out of contact with rollers of the dispensing mechanism.

29. A method for dispensing sheet material as recited in claim 28 wherein the dispensing roll of sheet material is supported at the constant axis during a minor portion of the dispensing of the sheet material.

30. A method for dispensing sheet material as recited in claim 29 including:

supporting a second reseve roll of sheet material in the dispenser above and out of contact with the dispensing roll;

simultaneously releasing the dispensing roll and the reserve roll from their supported positions after the diameter of the dispensing roll has been reduced a predetermined amount due to the dispensing of the sheet material and an amount of sheet material remains on the core of the dispensing roll;

guiding the dispensing roll downward to a storage position with the free end of its sheet material laying in contact with the transfer roller and threaded through the dispensing mechanism;

guiding the reserve roll downward to place the roll surface of the reserve roll of the sheet material in contact with the sheet material on the transfer roller from the dispensing roll in the storage position;

supporting the reserve roll out of contact with the rollers of the feed mechanism;

dispensing the remaining sheet material from the dispensing roll in the storage position to intiate dispensing of the sheet material from the reserve roll.

31. A method for dispensing sheet material as recited in claim 29 or 30 wherein the dispensing roll is initially supported on the transfer roller, during dispensing of the sheet material from the dispensing mechanism the axis about which the dispensing roll rotates lowers while the dispensing roll is supported on the transfer roller, and after a predetermining amount of sheet material has been dispensed, the dispensing roll is held at the constant axis.

* * * * *